US005461278A

United States Patent [19]

Misono et al.

[11] Patent Number: 5,461,278

[45] Date of Patent: Oct. 24, 1995

[54] ELECTRON GUN AND CATHODE-RAY TUBE COMPRISING THE SAME

[75] Inventors: Masayoshi Misono, Chiba; Atsushi Tsuruoka, Mobara, both of Japan

[73] Assignees: Hitachi, Ltd., Tokyo; Hitachi Device Engineering Co., Ltd., Chiba, both of Japan

[21] Appl. No.: 155,246

[22] Filed: Nov. 22, 1993

Related U.S. Application Data

[63] Continuation of Ser. No. 760,969, Sep. 17, 1991, abandoned.

[30] Foreign Application Priority Data

Sep. 17, 1990 [JP] Japan ..... 2-243740

[51] Int. Cl.[6] ..... H01J 29/50

[52] U.S. Cl. ..... 313/414; 313/449; 313/460

[58] Field of Search ..... 313/414, 449, 313/460

[56] References Cited

U.S. PATENT DOCUMENTS

| | | | |
|---|---|---|---|
| 4,581,560 | 4/1986 | Shirai et al. | 313/414 |
| 4,678,964 | 7/1987 | Peels | 313/414 |
| 4,833,364 | 5/1989 | Izumida et al. | 313/414 |
| 5,034,652 | 7/1991 | Shimona et al. | 313/414 |

*Primary Examiner*—Sandra L. O'Shea
*Assistant Examiner*—Matthew J. Esserman
*Attorney, Agent, or Firm*—Antonelli, Terry, Stout & Kraus

[57] ABSTRACT

In an electron gun wherein an electric field which is established between the axially opposed parts of a pair of electrodes forming a main lens has a rotationally-asymmetric distribution; electric-field correcting plates (54, 65 in FIG. 1B) are provided in the respective electrodes (5, 6) so as to render a lens action on electron beams substantially rotationally symmetric. The electron beams form smaller spots on the fluorescent screen of a cathode-ray tube than in the prior art.

12 Claims, 27 Drawing Sheets

ELECTRON GUN AND CATHODE-RAY TUBE COMPRISING THE SAME

This application is a continuation of application Ser. No. 07/760,969, filed on Sep. 17, 1991, now abandoned.

BACKGROUND OF THE INVENTION

1. Field of the Invention

The present invention relates to an electron gun which can attain excellent focusing characteristics balanced in the whole area of a fluorescent screen and a favorable resolution owing to the small diameters of electron beam spots on the fluorescent screen and a cathode-ray tube containing the electron gun.

2. Description of the Prior Art

In cathode-ray tubes each having an electron gun configured of a plurality of electrodes, a deflection device, and a fluorescent screen, various techniques have heretofore been proposed as expedients for obtaining a good picture over the surface of the fluorescent screen from the central part to the peripheral part.

By way of example, as disclosed in the official gazette of Japanese Patent Application Laid-open No. 103752/1983, electrodes constituting a main lens are formed with electron-beam passing holes which are noncircular.

With the electron gun of this structure, astigmatism corrections are made by mounting an electric-field correcting plate only within an anode, because appropriate astigmatism corrections are incompatible with the appropriate static concentration of an electron beam on the fluorescent screen.

In the above application, there are two reasons why the astigmatism corrections are required. The first reason is that, since a color cathode-ray tube now in use, having three electron guns arrayed in line employs a non-homogeneous deflecting magnetic field in order to simplify a convergence circuit, resolution at the peripheral edge of the screen of the cathode-ray tube is prevented from being lowered by the action of the deflecting magnetic field.

The second reason is to correct an astigmatism which arises when the electron beam passes through the noncircular electron-beam passing holes as stated in the official gazette.

Especially in the case where the electron-beam passing holes are formed in the noncircular shape as stated in the official gazette, the astigmatism lowers the resolution attributed to the deflecting magnetic field.

Accordingly, the amount of the astigmatism corrections based on the electric-field correcting plate is large and actually the astigmatism is not negligible even when compared with the spherical aberration of the main lens.

Therefore, the diameter of an electron beam spot on the fluorescent screen cannot be reduced to an extent corresponding to the enlargement of the electron lens attributed to the noncircular electron-beam passing holes.

In an electron gun disclosed in the official gazette of Japanese Patent Application Publication No. 36225/1989, the electron-beam passing holes of electrodes constituting a main lens are made circular, and an astigmatism is corrected only on the anode side of an electrode pair consisting of the focusing electrode and the anode which constitute the main lens.

The official gazette of Japanese Patent Application Publication No. 1344/1990 discloses improvements in the aforementioned structure of Japanese Patent Application Publication No. 36225/1989, wherein an astigmatism correcting portion mounted within the anode is shaped into a slot which extends in the in-line array direction of three electron guns less than the diameter of the electron-beam passing hole provided in the anode which is constructed of a metal plate.

In addition, the official gazette of Japanese Utility Model Registration Application Laid-open No. 18164/1975 discloses an electron gun wherein "U-shaped" auxiliary electrodes for electric field corrections are mounted inside respective electrodes which constitute a main lens.

The official gazette of Japanese Patent Application Publication No. 7375/1985 discloses an electron gun wherein the part of an anode on the side closest to the fluorescent screen is provided with an electric-field correcting portion cut and mounted in parallel with the direction of an in-line array while a focusing electrode is provided with a cut-and-mounted part between the electron-beam passing holes of the anode and the focusing electrode in a direction perpendicular to the in-line array direction.

SUMMARY OF THE INVENTION

Requirements for the focusing characteristics of a cathode-ray tube are that resolution for the full current range of the electron beams is required for the whole surface of the fluorescent screen, and that the resolution of the whole surface of the screen is uniform for the full current range.

Many techniques are necessitated for the design of an electron gun which satisfies the above-identified plurality of features.

With any of the prior-art techniques disclosed in the official gazettes of Japanese Patent Application Laid-open No. 103752/1983, Japanese Patent Application Publication No. 36225/1989 and Japanese Patent Application Publication No. 1344/1990, the electron gun furnished with an electron lens which is the equivalent of having a large aperture, in which the electric field distribution between the electrodes of the electrode pair constituting the main lens is rotationally asymmetric, but which is rotationally symmetric electrooptically, is applied to the cathode-ray tube having a neck with a diameter within a limited range, for reducing the diameter of the electron beam spot on the fluorescent screen to enhance the resolution. For this purpose, as means for correcting the distortion of an electron beam trajectory attributed to the rotationally-asymmetric electric field, only the anode of the electrodes constituting the main lens is provided with the electric-field correcting portion by which overall corrections are made.

Therefore, it is difficult to balance the amount of correction in the vicinity of the optic axis of the electron gun and the amount of correction at a position remote from the optic axis. As a result, the amount of correction of the individual electron-beam trajectories becomes excessive or deficient due to the distortion of the electric field. As a result, the prior art has the problem that the diameter of the electron beam spot on the fluorescent screen cannot be satisfactorily reduced.

It is accordingly the first object of the present invention to provide an electron gun in which the balance between the amount of correction in the vicinity of the optic axis of the electron gun and at a position remote from the optic axis is improved to relieve the distortion of an electric field and to reduce the diameter of an electron beam spot on a fluorescent screen, so that resolution on the fluorescent screen is enhanced; and also a cathode-ray tube containing the electron gun.

In the electron gun which employs the main lens having the electric field of rotationally asymmetric distribution, it is necessary to mount an electric-field correcting mechanism for normalizing the shape of the electron beam spots on the fluorescent screen.

The mounting position and structure of the electric-field correcting mechanism must have a high productivity for the purpose of supplying the market with cathode ray tubes of good quality and reasonable prices. Since, however, the prior-art technique referred to above makes the electric field corrections in the anode alone, the correction mechanism must be mounted at the position of the greatest correcting effect and be constructed for the greatest correcting effect.

Such a position and a structure affording the greatest correction effects are inevitably sensitive to an electric field change. Therefore, a high finishing accuracy and a high mounting accuracy are required of components for use with the result that the productivity of the correcting mechanism is hampered.

It is accordingly the second object of the present invention to provide an electron gun whose characteristics change little even when the electrode accuracy is reduced.

Further, the color cathode-ray tube having the three electron guns arrayed in line requires means for concentrating the electron beams emitted from the three electron guns onto one point on the fluorescent screen.

Usually, the three electron-beam spots, which are previously focused by the structure of the electron gun electrodes, are focused at a still higher accuracy by a magnet installed in the neck portion of the cathode-ray tube.

For a mechanism for the above prefocusing, there is a method wherein the optic axes of the opposing parts of the electrodes constituting the main lens are offset and an electric field within the electrodes is distributed so as to curve the trajectory of the electron beam.

When the electron beams are concentrated by such a method, the electric field within the electron lens inevitably becomes rotationally asymmetric to give rise to an astigmatism.

In the design of an electron gun, it is desirable to be capable of greatly altering astigmatisms which include the astigmatism arising simultaneously with the concentration of the electron beams while affecting the concentration of the electron beams as little as possible.

In such a situation, the concentration of the electron beams and the astigmatisms can be treated as independent variables. Therefore, the versatility of the design increases and facilitates the design of the electron gun having the required characteristics.

It is accordingly the third object of the present invention to provide an electron gun with a structure in which the concentration of electron beams and astigmatisms can be independently corrected to attain appropriately-balanced focusing characteristics and favorable resolutions for the whole surface of a screen; and also a cathode-ray tube containing the electron gun.

The present invention accomplishes the first object by having a plurality of electric-field correcting mechanisms located within electrodes constituting a main lens.

The present invention accomplishes the second and third objects thereof by using a plurality of electric-field correcting mechanisms located at positions spaced in the direction of an optic axis from the opposing parts of electrodes constituting the main lens with respect to the parts which separate the three electron-beam passing holes and which are formed in the opposing parts.

The first, second and third objects thereof are achieved with the electric-field correcting mechanism being formed with electron-beam passing holes which are rotationally asymmetric with the electron-beam passing holes including ones which respectively correspond to three electron beams and one which is common to the three electron beams.

As a consequence of the astigmatism correcting mechanisms being located in a plurality of places within the electrodes constituting the main lens, it is possible to prevent an increase in the diameter of electron beam spots on a fluorescent screen for making astigmatism corrections as in the prior art.

More specifically, the trajectory of the electron beam is gradually corrected along the optic axis of the electron beam so that electric field corrections in the vicinity and remote from the optic axis can be appropriately balanced.

As a result, the diameter of the electron beam spot on the fluorescent screen can be reduced and resolution for the whole surface of the fluorescent screen can be enhanced.

In addition as a consequence of the provision of the electric-field correcting mechanisms in the pair of electrodes constructing the main lens, at positions spaced in the direction of the optic axis, it is possible to lower the correctional accuracy of each of the electric-field correcting mechanisms for use in making the astigmatism corrections.

Thus the electric field weakens on each side spaced from the opposed parts of the pair of electrodes constructing the main lens, as compared to the electric field in the vicinity of the opposed parts, so that the electric field is less affected even when the accuracy of the electric-field correcting mechanism is lowered.

The electric-field correcting mechanisms are mounted in the respective electrodes constituting the main lens and the corrections of the individual electric-field correcting mechanisms are made small which permits the mounting positions of both the electric-field correcting mechanisms to be spaced from the opposed parts in the direction of the optic axis and the standards of fabrication accuracy to be lessened.

Further, due to the provision of the electric-field correcting mechanisms at the positions which are spaced from the opposed parts of the electrodes constituting the main lens, the concentration of the three electron beams on the fluorescent screen and the electric field corrections for correcting astigmatisms can be rendered independently of each other and the versatility of the design of the electron gun is increased.

Herein, even when the electric-field correcting mechanisms are disposed at the positions spaced from the opposed parts of the electrode pair constructing the main lens, the astigmatism corrections are possible under the shielding actions of the opposed parts and the influence on the concentration of the electron beams is negligible.

The terminology "rotationally asymmetric" signifies any shape other than a shape defined by the locus of points equidistant from the center of rotation. For example, a "rotationally-asymmetric beam spot" is intended to mean a noncircular beam spot.

DESCRIPTION OF THE PREFERRED EMBODIMENTS

First mechanisms are explained in which the focusing characteristics and resolution of a cathode-ray tube are enhanced by the use of an electron gun according to the present invention.

Figure 20:
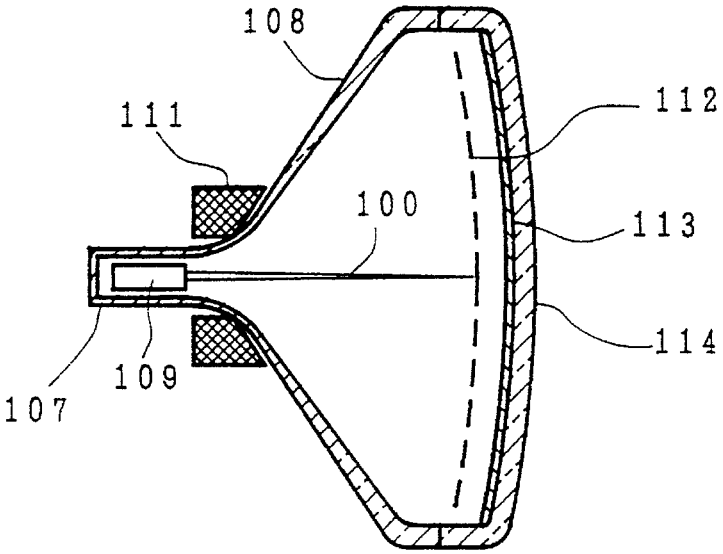
FIG. 20 PRIOR ART
FIG. 20 is a view used for explaining a shadow mask type color cathode-ray tube which is furnished with in-line electron guns.

FIG. 20 is an explanatory view of a shadow mask type color cathode-ray tube furnished with in-line electron guns. The color cathode-ray tube has a neck 107, a funnel 108, an electron gun assembly 109 which is received in the neck 107 which emits an electron beam 100, a deflection yoke 111, a shadow mask 112, a phosphor film 113, and a panel (screen) 114 (in the ensuing description, the panel 114 with the phosphor film 113 deposited thereon shall be termed a "fluorescent screen 14").

As illustrated in FIG. 20, with the cathode-ray tube of the specified type, the electron beam 100 emitted from the electron gun 109 is passed through the shadow mask 112 while being deflected in horizontal and vertical directions by the deflection yoke 111, causing the phosphor film 113 to phosphoresce. A pattern based on the phosphorescence is observed as a picture on the side of the panel 114.

Figure 21:
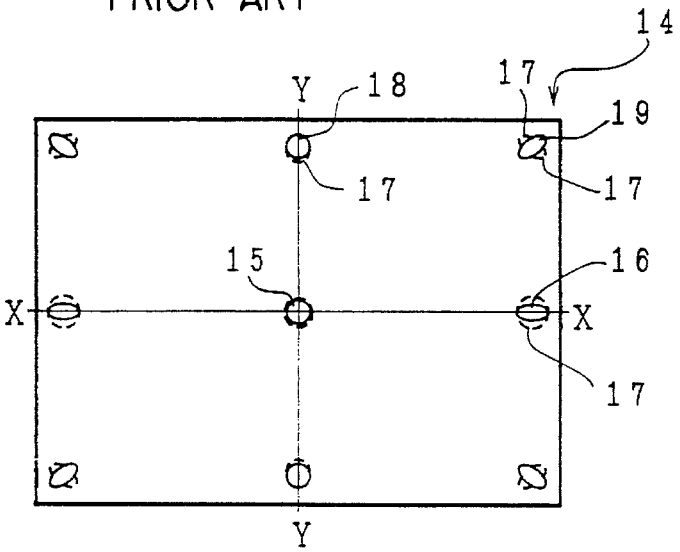
FIG. 21 PRIOR ART
FIG. 21 is a diagram for explaining electron beam spots when the peripheral edge of a fluorescent screen is caused to fluoresce by an electron beam which forms a circular spot on the central part of the fluorescent screen.

FIG. 21 is a diagram used for explaining electron beam spots when the peripheral edge of a fluorescent screen is caused to fluoresce by an electron beam which forms a circular spot on the central part of the fluorescent screen. Referring to FIG. 21, numeral 14 designates the fluorescent screen, on which the beam spot 15 at the central part of a screen is formed. The beam spots 16 are formed at the ends of the screen in the horizontal direction (X—X direction) thereof, the beam spots 18 at the ends of the screen in the vertical direction (Y—Y direction) thereof, and the beam spots 19 at the ends of the screen in the diagonal directions (at the corner parts) thereof. Numerals 17 indicate haloes.

In recent color cathode-ray tubes, an inhomogeneous magnetic field distribution having a horizontal deflection field in the shape of a pincushion and a vertical field in the shape of a barrel is employed in order to simplify a convergence control.

The shape of the fluorescent spot based on the electron beam is not circular at the peripheral part of the fluorescent screen for the reasons that the magnetic field distribution as stated above causes the trajectories of the electron beam to differ at the central and peripheral parts of the fluorescent screen causing the electron beam to impinge obliquely onto a phosphor film at the peripheral part of the fluorescent screen.

As shown in FIG. 21, the spot 16 at the horizontal end of the screen becomes laterally long and includes the halo 17 in contrast to the circular spot 15 at the central part.

As a consequence, the dimension of the spot in the horizontal direction enlarges and the contour of the spot becomes unclear due to the halo causing the resolution to degrade to drastically lower picture quality.

Further, in a case where the current of the electron beam is of small quantity, the diameter of the electron beam in the vertical direction is excessively reduced to optically interfere with the pitch of the shadow mask 112 in the vertical direction. Then, a moire is produced, and the picture quality is lowered.

Furthermore, the spot 18 at the vertical end of the screen 14 has a laterally-bulging shape for the reason that the electron beam is vertically converged by the deflecting magnetic field in the vertical direction. Also spot 18 has a halo 17 which lowers the picture quality.

The electron beam spot 19 at the corner part of the fluorescent screen 14 undergoes rotation in addition to the lateral elongation like spot 16 and the lateral bulging like spot 18. Consequently spot 19 not only has the appearance of halo 17 but also an enlargement in diameter which drastically lowers the picture quality.

Figure 22:
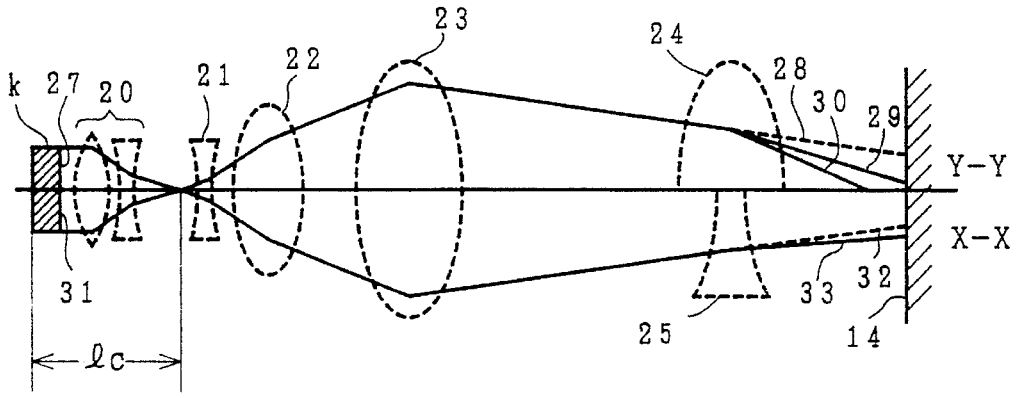
FIG. 22 is a model diagram of the electrooptic system of an electron gun for explaining the deformation of an electron beam spot.

FIG. 22 is a model diagram of the electrooptic system of an electron gun for explaining the deformation of the electron beam spot as stated above. In FIG. 22, the foregoing system is replaced with an optical system in order to facilitate understanding.

In FIG. 22, the upper half of the diagram shows the vertical (Y—Y) section of the fluorescent screen, while the lower half shows the horizontal (X—X) section of the fluorescent screen.

Here, numerals 20 and 21 designate prefocusing lenses, numeral 22 a preceding-stage of the main lens, and numeral 23 a main lens. The prefocusing lenses 20, 21, preceding-stage of the main lens 22, and main lens 23 construct the electrooptic system which corresponds to the electron gun 109 in FIG. 20.

Numeral 24 is a lens which is developed by the vertical deflecting magnetic field. Numeral 25 is an equivalent lens which expresses a lens developed by the horizontal deflecting magnetic field together with the fact that the deflected electron beam is apparently stretched out in the horizontal direction by its oblique impingement on the fluorescent screen 14.

First, an electron beam 27 which is emitted from a cathode K and whose section is in the vertical direction of the fluorescent screen 14 forms a crossover P at a distance $l_c$ from the cathode K between the prefocusing lenses 20 and 21. Thereafter, the electron beam 27 is converged toward the fluorescent screen 14 by the preceding-stage of the main lens 22 as well as the main lens 23.

The electron beam impinges on the fluorescent screen 14 through a trajectory 28 at the central part of the fluorescent screen where no deflection is involved. At the peripheral part of the fluorescent screen 14, however, the electron beam forms a laterally-bulging beam spot through a trajectory 29 under the action of the lens 24 developed by the vertical deflecting magnetic field.

Further, since the main lens 23 has a spherical aberration, part of the electron beam focalizes before reaching the fluorescent screen 14, as indicated by a trajectory 30. This is the reason for the appearance of the halo 17 of the spot 18 at the vertical end part of the fluorescent screen or the halo 17 of the spot 19 at the corner part thereof as illustrated in FIG. 21.

On the other hand, an electron beam 31 which is emitted from the cathode K and whose section is in the horizontal direction of the fluorescent screen 14 is converged by the prefocusing lenses 20, 21, preceding-stage of the main lens 22 and main lens 23 similarly to the electron beam 27 of the vertical section. It impinges on the fluorescent screen 14 through a trajectory 32 at the central part of this screen where the action of the deflecting magnetic field is null.

Even where the deflecting magnetic field acts, no halo appears in the horizontal direction though the electron beam 31 forms a laterally-long spot shape through a trajectory 33 under the diverging action of the lens 25 caused by the horizontal deflecting magnetic field.

The electron beam spot 16 at the horizontal end part in FIG. 21 at which no vertical deflecting action is involved has the halo 17 for the reason that the distance between the main lens 23 and the fluorescent screen 14 is longer at the horizontal end part of this screen than at the central part thereof causing part of the electron beam to be focused before reaching the fluorescent screen 14 in the vertical section.

In this manner the shape of the electron beam spot at the central part of the screen is made circular in the rotationally-symmetric lens system of the structure when the lens system of the electron gun is configured of the same systems in the horizontal and vertical directions and the shape of the electron beam spots at the peripheral parts of the screen become distorted drastically lowering the picture quality.

Figure 23:
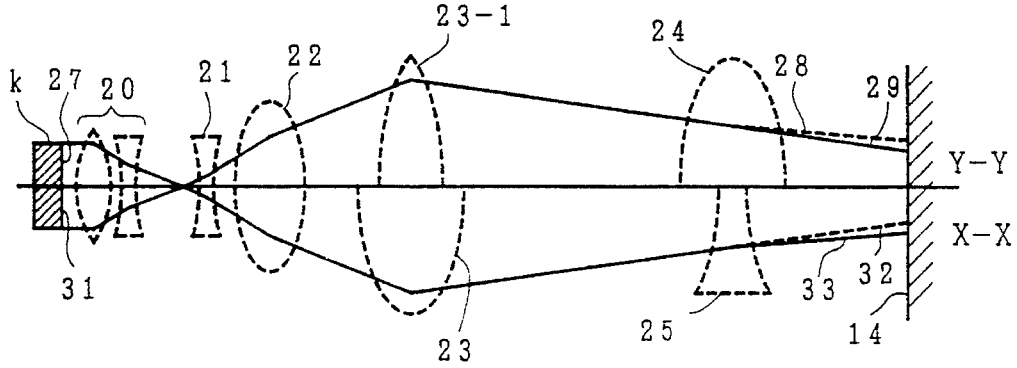
FIG. 23 is an explanatory diagram of a mechanism for suppressing the lowering of picture quality at the peripheral part of the fluorescent screen as explained in conjunction with FIG. 22.

FIG. 23 is an explanatory diagram of a mechanism for preventing the lowering of the picture quality at the peripheral edge of the fluorescent screen as explained in conjunction with FIG. 22.

As illustrated in FIG. 23, the converging action of a main lens 23-1 in the vertical section of the screen 14 is rendered weaker than that of the main lens 23 in the horizontal section.

Thus, even after the electron beam has passed through the lens 24 developed by the vertical deflecting magnetic field, it proceeds along the illustrated trajectory 29 so that the extreme lateral bulging as shown in FIG. 22 does not arise. The halo 17 does not appear.

However, the trajectory 28 at the central part of the fluorescent screen 14 shifts in the direction causing an increase in the diameter of the electron beam spot.

Figure 24:
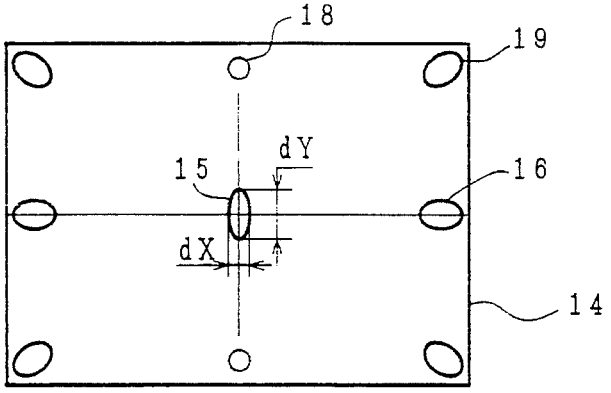
FIG. 24 is a diagram used for explaining the shape of an electron beam spot on the fluorescent screen in the case of employing the lens system shown in FIG. 23.

FIG. 24 is a model diagram for explaining shapes of electron beam spots which are formed on the fluorescent screen 14 when employing the lens system shown in FIG. 23. The haloes are prevented in the spots 16 at the horizontal end parts, the spots 18 at the vertical end parts and the spots 19 at the corner parts so that resolution in the peripheral parts is enhanced.

In the spot 15 at the central part of the fluorescent screen 14, however, the diameter dY thereof in the vertical direction is larger than the diameter dX in the horizontal direction. The resolution in the vertical direction is degraded.

From the standpoint of simultaneously enhancing the resolution over the whole screen, accordingly, a fundamental solution is not achieved establishing the rotationally-asymmetric electric field system with focusing effects of the main lens 23 in the vertical and horizontal directions of the screen being different.

On the basis of the above considerations, the present invention has enhanced both the convergence of electron beams and the resolution on a screen by taking the measures stated before. Now, embodiments will be concretely described with reference to the drawings.

Figure 1A:
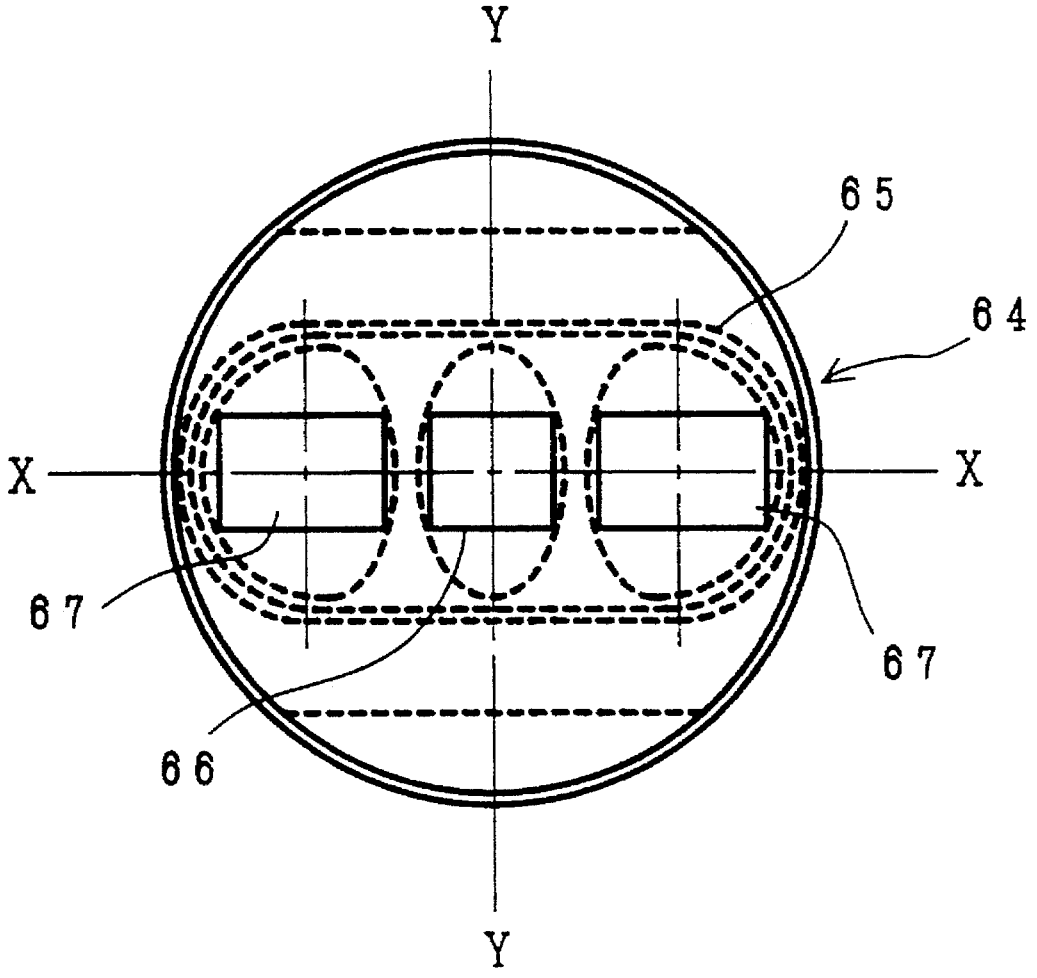
FIGS. 1A and 1B are views for explaining an embodiment of an electron gun according to the present invention.
Figure 1B:
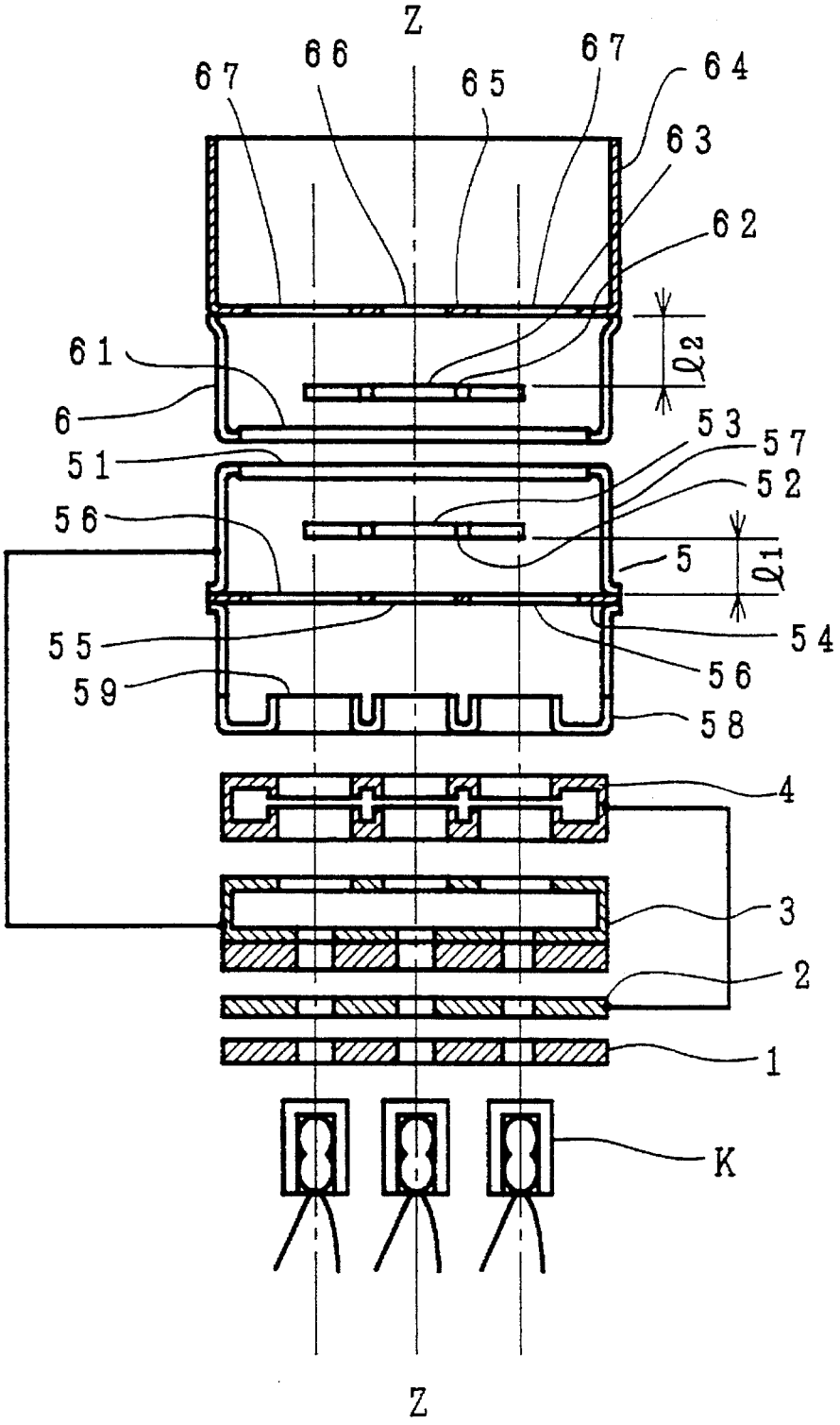

FIGS. 1A and 1B illustrate an embodiment of an electron gun according to the present invention in which FIG. 1A is a front view of the electron gun as seen from the anode side thereof, while FIG. 1B is an X—X sectional view of the electron gun along section line X—X as taken along a Z—Z axis (the axis of a cathode-ray tube).

Referring to FIGS. 1A and 1B, the electron gun assembly comprises a $G_1$-electrode 1, a $G_2$-electrode 2, a $G_3$-electrode 3, a $G_4$-electrode 4, a G-electrode 5, a $G_6$-electrode 6, and cathodes K. The $G_3$-electrode 3 and $G_5$-electrode 5 are focusing electrodes, and the $G_6$-electrode 6 is an anode. A main lens is formed by the opposed parts of an electrode pair which consists of the $G_5$-electrode (focusing electrode) 5 and $G_6$-electrode (anode) 6.

The adjacent ones of these electrodes are spaced at a proper distance from each other and are held by glass beads which are not illustrated.

During the operation of the electron gun, a suppressing power source is connected to the $G_2$-electrode 2 and $G_4$-electrode 4, a focusing power source to the $G_3$-electrode 3 and $G_5$-electrode 5, and an anode power source to the $G_6$-electrode 6. The $G_1$-electrode 1 is grounded.

In addition, numeral 51 designates a part of the $G_5$-electrode 5 opposed to the $G_6$-electrode 6, numeral 52 the inner electrode of the $G_5$-electrode 5, numeral 53 the opening of the $G_5$ inner electrode 52, numeral 54 a $G_5$-electrode correction plate, numerals 55 and 56 the openings of the $G_5$ electric-field correcting plate 54, numerals 57 and 58 the side wall portions of the $G_5$-electrode 5, and numeral 59 the electron-beam passing holes of the $G_5$-electrode 5 on the side of the $G_4$-electrode 4.

Numeral 61 indicates the part of the $G_6$-electrode 6 opposed to the $G_5$-electrode 5, numeral 62 the inner electrode of the $G_6$-electrode 6, numeral 63 the opening of the $G_6$ inner electrode 62, numeral 64 a shielding cup, numeral 65 a $G_6$ electric-field correcting plate, and numerals 66 and 67 the openings of the $G_6$ electric-field correcting plate 65.

In the illustrated assembly, the main lens is formed in such a way that the electric field between the $G_5$ inner electrode 52 and the $G_6$ inner electrode 62 is determined mainly by the part 51 of the $G_5$-electrode 5 opposed to the $G_6$-electrode 6, as well as the $G_5$ inner electrode 52, and the part 61 of the $G_6$-electrode 6 opposed to the $G_5$-electrode 5, as well as the $G_6$ inner electrode 62. The electric field of an internal side more remote from the part 51 opposed to the $G_6$-electrode 6, than the $G_5$ inner electrode 52 in the direction of the tube axis Z—Z is determined by the $G_5$ electric-field correcting plate 54 while the electric field of an internal side more remote from the part 61 opposed to the $G_5$-electrode 5, than the $G_6$ inner electrode 62 in the axial direction, is determined by the $G_6$ electric-field correcting plate 65.

In the construction shown in FIGS. 1A and 1B, the $G_6$ electric-field correcting plate 65 is formed by part of the shielding cup 64.

In the illustrated embodiment, the opening 53 of the $G_5$ inner electrode 52 and the opening 63 of the $G_6$ inner electrode 62 are not circular and the part 51 of the $G_5$-electrode 5 opposed to the $G_6$-electrode 6 and the part 61 of the $G_6$-electrode 6 opposed to the $G_5$-electrode 5 are also not circular. Therefore, the actions of converging and diverging an electron beam between the $G_5$ inner electrode 52 and the $G_6$ inner electrode 62 during the operation of the cathode-ray tube are different in the in-line direction of the electron gun assembly and noncircular in a direction perpendicular to the in-line direction. On the $G_6$-electrode side, however, the converging actions in the in-line direction and in the perpendicular direction can be controlled because of the action of lens by use of appropriate shapes of the openings 66, 67 of the $G_6$ electric-field correcting plate 65 and the distance $l_2$ between the $G_6$ inner electrode 62 and the $G_6$ electric-field correcting plate 65.

In this regard, however, the shapes and positions of the openings of the $G_5$ electric-field correcting plate 54 and those of the openings of the $G_6$ electric-field correcting plate 65 are not uniquely determined for controlling the focusing actions of the main lens in the in-line direction and in the perpendicular direction.

By way of example, even when the electric-field correcting action of the $G_5$ electric-field correcting plate 54 is zero, the focusing actions of the main lens in the in-line direction and in the perpendicular direction can be controlled by setting the electric-field correcting action of the $G_6$ electric-field correcting plate 65 in a predetermined state.

Since, however, the function of the main lens is to focus a smaller electron-beam spot on the fluorescent screen of the cathode-ray tube, it is unsatisfactory to merely control the focusing actions of the main lens in the in-line direction and in the perpendicular direction.

In general, the focusing of an electron beam by a main lens should preferably be as small as possible in order to focus an electron beam of smaller diameter on a fluorescent screen.

Such a state can be realized by varying the electric field within the main lens smoothly and gradually in the axial direction of the cathode-ray tube and in the radial direction of the main lens.

According to the present invention, the electric field variation can be realized.

In the embodiment of FIGS. 1A and 1B, in order to smoothly and gradually vary the distribution of the electric field within the main lens as described above, the electric-field correcting plate 54 is provided in the $G_5$-electrode 5, and the electric-field correcting plate 65 is provided also in the $G_6$-electrode 6.

In the interior of the $G_5$-electrode 5, the electron-beam converging actions in the in-line direction and in the perpendicular direction are substantially controlled by the action of the electric-field correcting plate 54. In the interior of the $G_6$-electrode 6, the electron-beam converging actions in the in-line direction and in the perpendicular direction are substantially controlled by the action of the electric-field correcting plate 65.

Figure 2A:
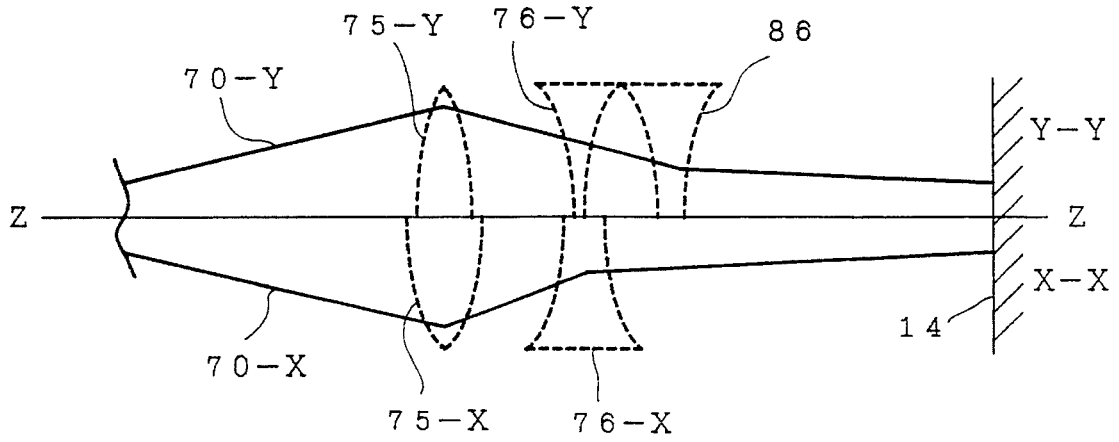
FIG. 2A PRIOR ART
FIGS. 2A and 2B are model diagrams used for explaining focusing and diverging actions on an electron bean in a main lens system in comparison with those in the prior art.
Figure 2B:
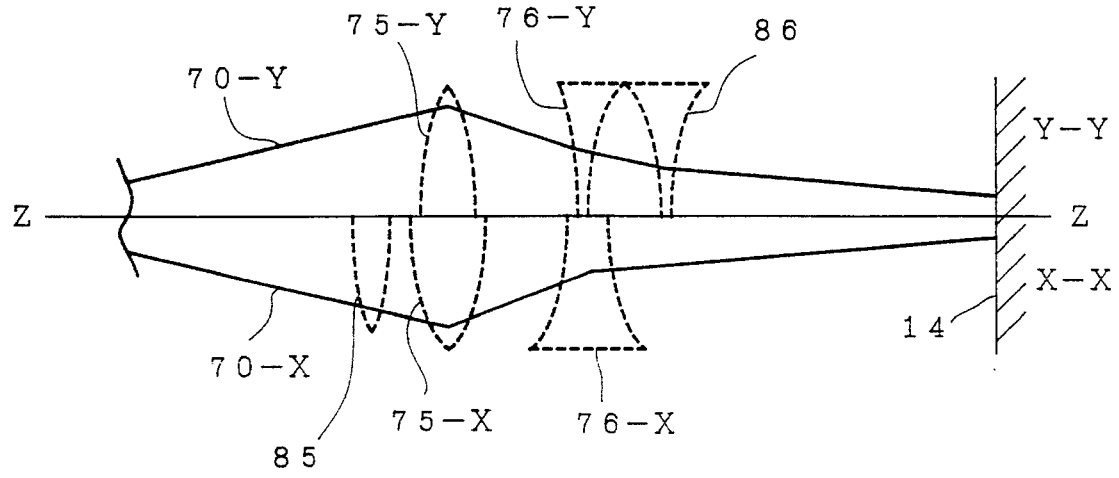

FIGS. 2A and 2B are model diagrams for explaining the actions of converging and diverging an electron beam in the main lens system, in comparison with those in the prior art. FIG. 2A illustrates the prior art, while FIG. 2B illustrates the present invention. In each of FIGS. 2A and 2B, the electron lens system is expressed by an optical lens system in order to facilitate the explanation.

In each diagram, a part above the central axis Z—Z of the optical system shows a section in the direction (Y direction) perpendicular to the in-line direction of the electron gun assembly, while a part below the axis shows a section in the in-line direction (X direction). Portions having similar actions in the X direction and the Y direction have letters X and Y affixed behind the reference numerals of the portions.

Numeral 75 indicates a convex lens which is equivalent to the converging action in the vicinity of the $G_5$ inner electrode 52 in FIG. 1B. In this embodiment, the converging action is weaker in the Y section than in the X section. Numeral 76 denotes a concave lens which is equivalent to the diverging action in the vicinity of the $G_6$ inner electrode 62 in FIG. 1B.

Further, a convex lens 85 is equivalent to the converging action in the vicinity of the $G_5$ inner electrode 52 caused by the electric-field correcting plate 54 which is mounted in the $G_5$-electrode 5. A concave lens 86 is equivalent to the diverging action in the vicinity of the $G_6$ inner electrode 62 caused by the electric-field correcting plate 65 which is mounted in the $G_6$-electrode 6.

FIG. 2A corresponds to the prior-art technique wherein only the $G_6$-electrode 6 is provided with the electric-field correcting plate 65. Since, with this construction, the overall corrections are made by the electric-field correcting plate 65 having only the diverging action of the Y section, a distortion occurs in the electric field in the vicinity of the electric-field correcting plate 65 making it difficult to reduce the diameter of an electron beam spot on the fluorescent screen 14.

On the other hand, the construction of FIG. 2B according to the present invention employs the $G_5$ electric-field correcting plate 54 having the converging action in only the X section within the $G_5$-electrode 5, and the $G_6$ electric-field correcting plate 65 having the diverging action in only the Y section.

The converging action of the whole system of the X and Y sections as based on the combination of the $G_5$ electric-field correcting plate 54 and the $G_6$ electric-field correcting plate 65 is set to be equivalent to the converging action of the construction in FIG. 2A.

In the construction of FIG. 2B, the electric field corrections are made in two places so that the variation of the electric field based on the electric-field correcting plates is smaller and the distortion of the trajectory of the electron beam is less as compared with the construction of FIG. 2A. Therefore, the diameter of the electron beam spot on the fluorescent screen 14 can be made smaller than in the construction of FIG. 2A.

In the foregoing embodiment in FIG. 1B, the electric-field correcting plate 54 is made of a flat conductor member formed with the three independent openings 55, 56 and the electric-field correcting plate 65 is similarly made of a flat conductor member formed with the three independent openings 66, 67.

The electric-field correcting plate 65 may be made of part of the shielding cup 64 or a component independent of the shielding cup 64.

Figure 3A:
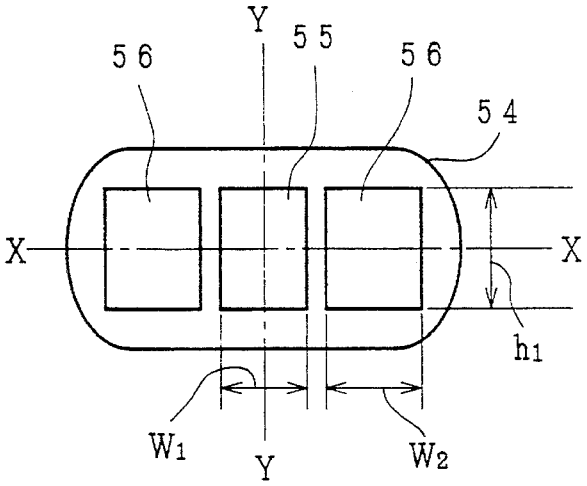
FIGS. 3A and 3B are views used for explaining an example of a $G_5$-electrode electric-field correcting plate in FIG. 1B.
Figure 3B:
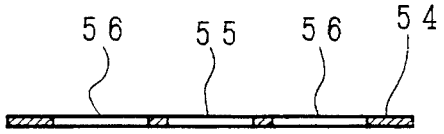

FIGS. 3A and 3B are a front view and a sectional view taken along line X—X in FIG. 3A, respectively, showing an example of the $G_5$ electric-field correcting plate 54 in FIG. 1B. In this electric-field correcting plate 54, the opening 55 for the central electron gun (central electron beam) of the electron gun assembly and the openings 56 for the sideward electron guns (sideward electron beams) have opening widths respectively $W_1$ and $W_2$ in the in-line direction of the electron gun assembly.

The numerical values of the widths $W_1$ and $W_2$ are determined in accordance with the desired characteristics of the whole main lens system.

In particular, in the case where the structures of the central electron gun and sideward electron guns are unequal as in the embodiment of FIGS. 1A and 1B, the widths $W_1$ and $W_2$ become different values.

An opening width $h_1$ in the direction perpendicular to the in-line direction as indicated in FIG. 3A is also determined for the desired characteristics of the whole main lens system. The value of the opening width $h_1$ can be different between the central electron gun and each sideward electron gun.

Figure 4A:
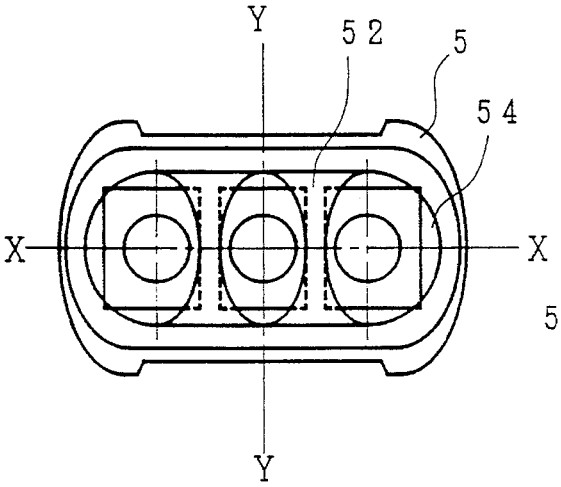
FIGS. 4A and 4B are views used for explaining an example of a $G_5$-electrode in FIG. 1B.
Figure 4B:
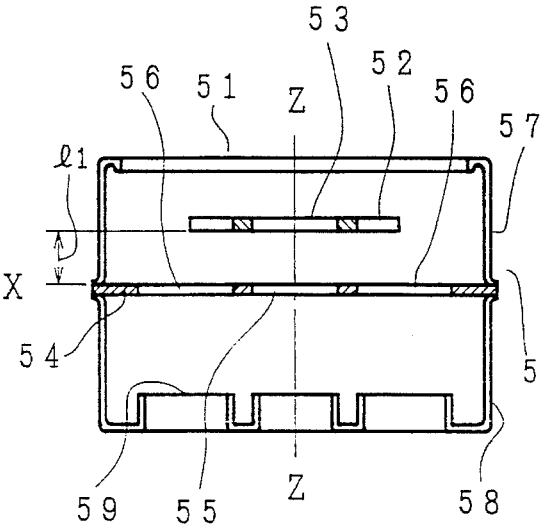

FIGS. 4A and 4B are a front view and a sectional view taken along line X—X in FIG. 4A, respectively, showing an example of the $G_5$-electrode 5 in FIG. 1B.

Referring to FIGS. 4A and 4B, the electric-field correcting plate 54 is located at a position which is spaced from the part 51 opposed to the $G_6$-electrode more than the inner electrode 52.

The inner electrode 52 is so constructed that the opening 53, which is aligned with the central one of the three electron guns arrayed in line, is in the shape of an ellipse having a minor diameter in the in-line direction and the inner side of each of the portions is aligned with both the sideward electron guns which inner side is near to the central electron gun, is also in the shape of an ellipse having a minor diameter in the in-line direction. The outer side, which side is remote from the central electron gun, is not provided with any plate-like part. Here, this plate-like part is formed by part of the side wall portion 57 of the $G_5$-electrode 5.

The distance $l_1$ between the inner electrode 52 and the electric-field correcting plate 54 is set to obtain a balanced state of characteristics such as the focusing characteristics of the electron guns, the static concentration of electron beams projected from the three electron guns on the fluorescent screen, the shape of the inner electrode 52 and the distance between the inner electrode 52 and the part 51 opposing to the $G_6$-electrode.

In actuality, in the present invention, both the $G_5$_electrode 5 and the $G_6$-electrode 6 which are the constituent electrodes of the main lens are respectively furnished with the electric-field correcting plates 54 and 65, and therefore, the required amount of correction of each of the electric-field correcting plates is smaller than when employing either of the correcting plates alone, so that the distance $l_1$ between the inner electrode 52 and the electric-field correcting plate 54 can assume a large value.

Consequently, the electric-field correcting plates exert great influence on the electron-beam converging actions in the in-line direction and in the direction perpendicular to the in-line direction, but they exert little influence on the electrostatic concentration on the fluorescent screen due to the shielding action of the inner electrode 52.

When the electric-field correcting plate 54 has the shape of its openings and its position set in designing the electron gun assembly, the converging the electron beam and the static concentration of the three electron beams on the fluorescent screen can be considered to be substantially independent variables. This advantage increases the versatility of the design remarkably.

Figure 5:
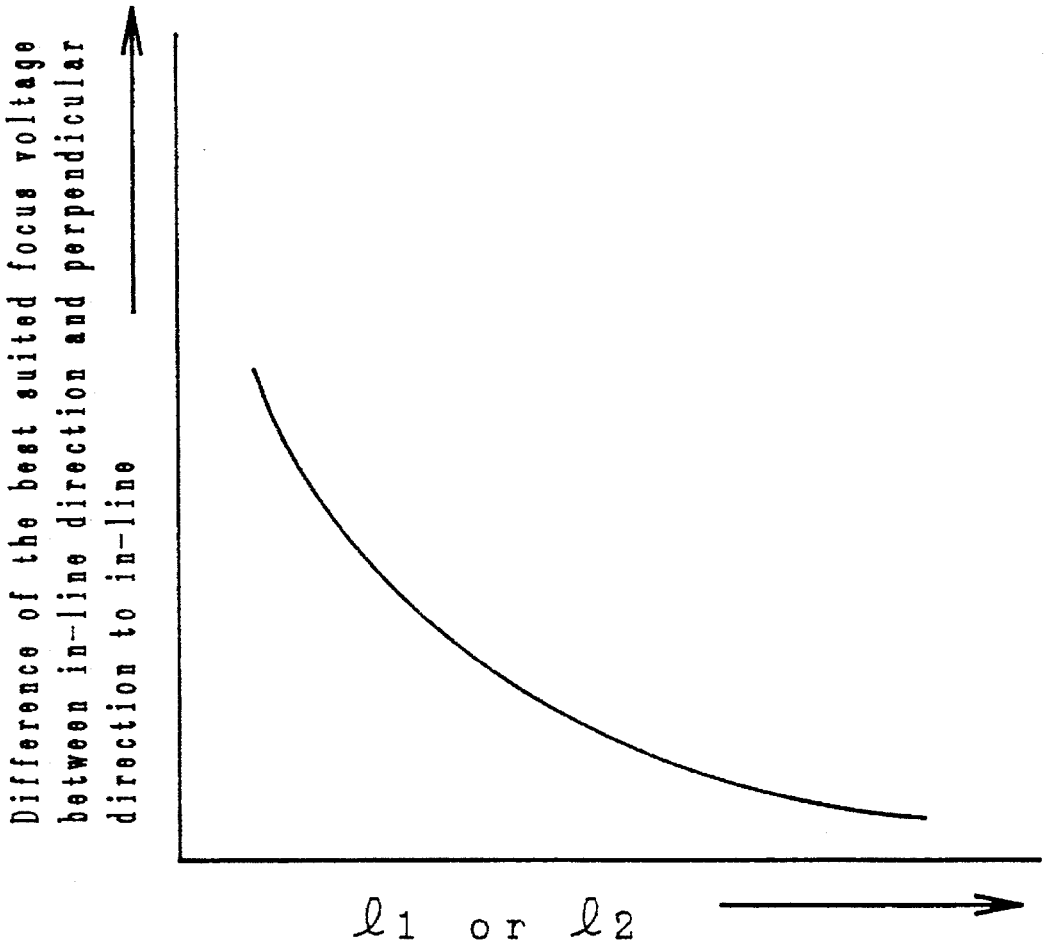
FIG. 5 is a graph used for explaining the relationship of an electron-beam focusing action to the distance between each electric-field correcting plate and a corresponding inner electrode in FIG. 1B.

FIG. 5 is a graph for use in explaining the relationship of the electron-beam converging action to the distance ($l_1$ or $l_1$) between the electric-field correcting plate and the inner electrode in FIG. 1B. In the graph, the abscissa represents the above distance ($l_1$ or $l_1$), while the ordinate represents the difference of (optimum focusing voltage in the in-line direction)—(optimum focusing voltage in the direction perpendicular to the in-line array).

First, regarding the electric-field correcting plate 54 which is mounted in the $G_5$-electrode 5, the influence thereof on the converging action diminishes with an increase in the distance ($l_1$) between the electric-field correcting plate 54 and the inner electrode 52, as illustrated in FIG. 5.

This indicates that when the electric-field correcting plate 54 is located at a position spaced from the inner electrode 52, the influence on the performance is small even in the presence of some error in the accuracy of the electric-field correcting plate.

In addition, the shapes of the openings of the electric-field correcting plate 54 and the positional relationship of plate 54 with the inner electrode 52 are determined from the shape of the inner electrode 52, the distance between the $G_5$-electrode 5 and the $G_6$-electrode 6, the shape of the part 51 of the $G_5$-electrode 5 opposed to the $G_6$-electrode 6, and the characteristics of a required electron gun assembly, etc.

The specifications of the electric-field correcting plate 65 which is mounted in the $G_6$-electrode 6 are determined substantially similarly to the specification of the electric-field correcting plate 54 which is mounted in the $G_5$-electrode 5.

Figure 6A:
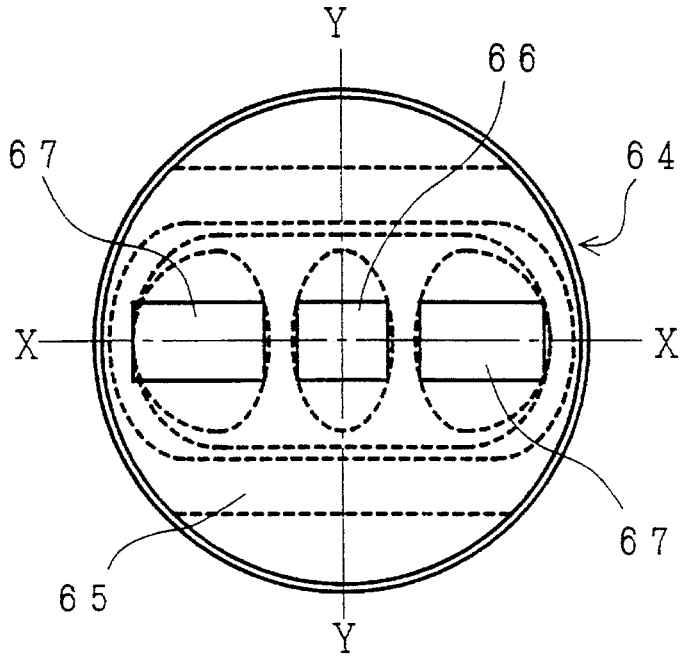
FIGS. 6A thru 6D are views for explaining an example of a $G_6$-electrode in FIG. 1B.
Figure 6B:
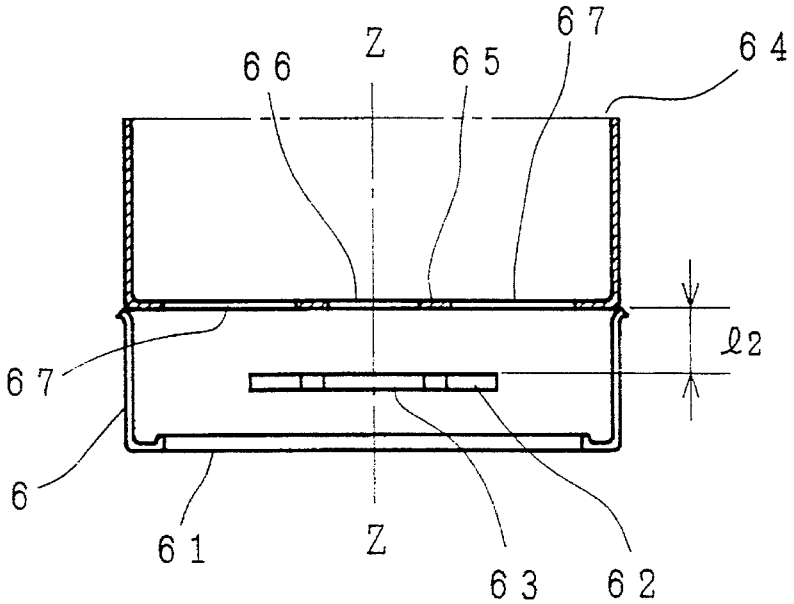
Figure 6C:
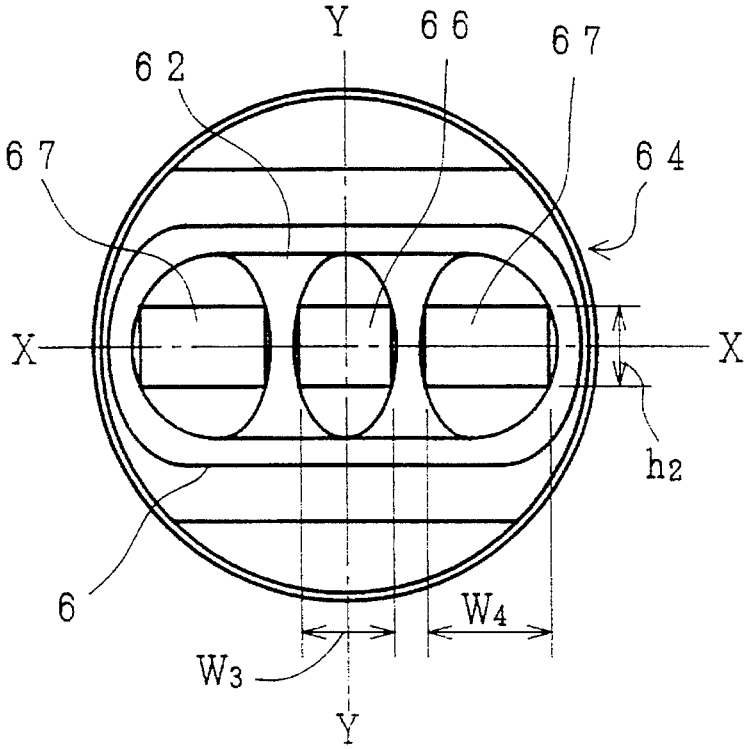
Figure 6D:
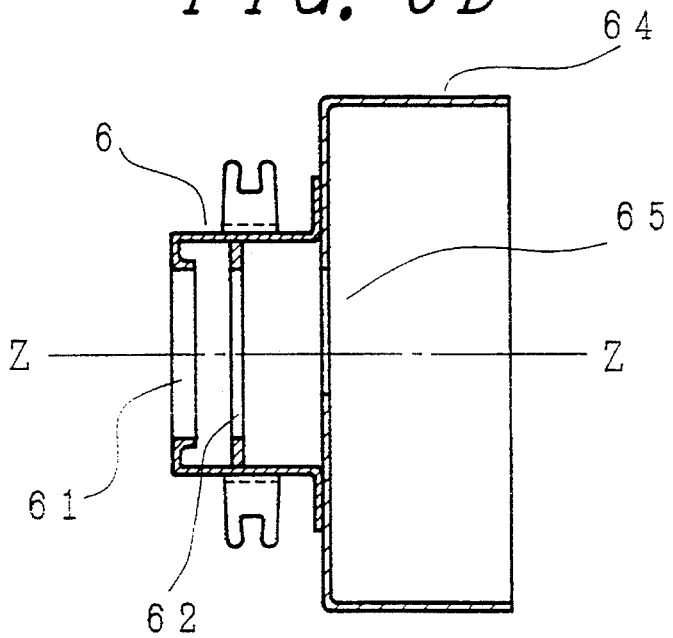

FIGS. 6A thru 6D illustrate an example of the $G_6$-electrode 6, in which FIG. 6A is a front view on the side of the shielding cup 64, FIG. 6B is a sectional view taken along line X—X in FIG. 6A, FIG. 6C is a front view on the side of the $G_5$-electrode 5, and FIG. 6D is a sectional view taken along line Y—Y in FIG. 6C.

As shown in FIGS. 6A thru 6D, the three openings of the electron-beam passing holes of the electric-field correcting plate 65 which is mounted in the $G_6$-electrode 6 are rectangles.

Now, the electrodes of the electron gun assembly according to the present invention will be described in order.

Figure 7A:
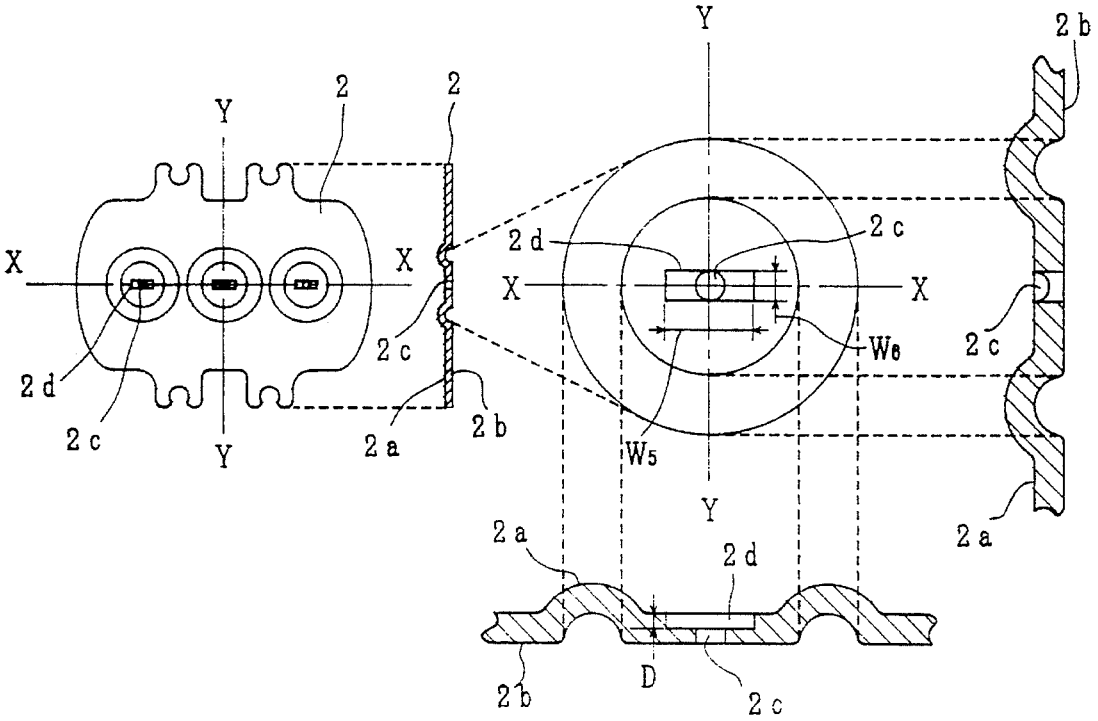
FIGS. 7A thru 7D are views used for explaining major electrodes in FIG. 1B.
Figure 7B:
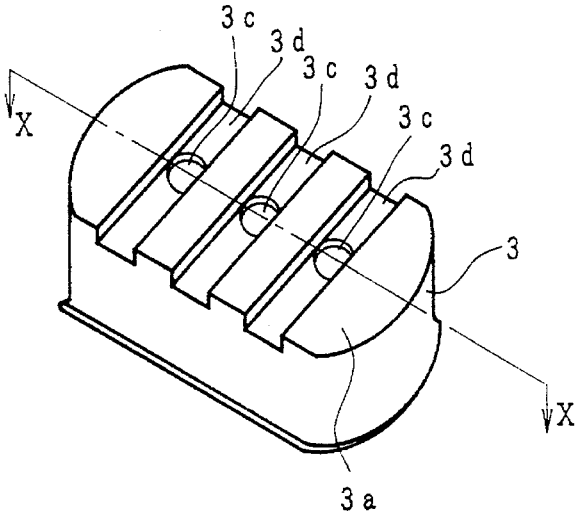
Figure 7C:
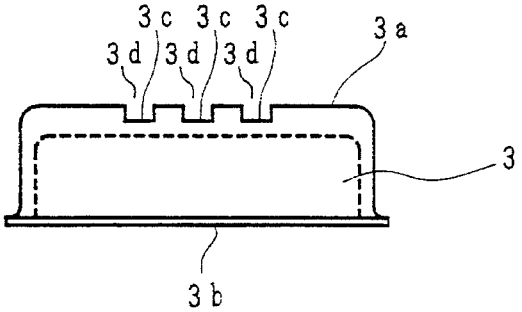
Figure 7D:
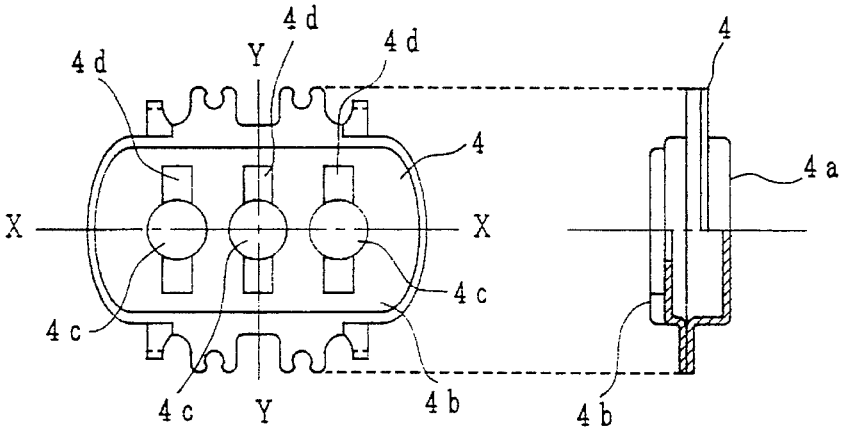
Figure 8A:
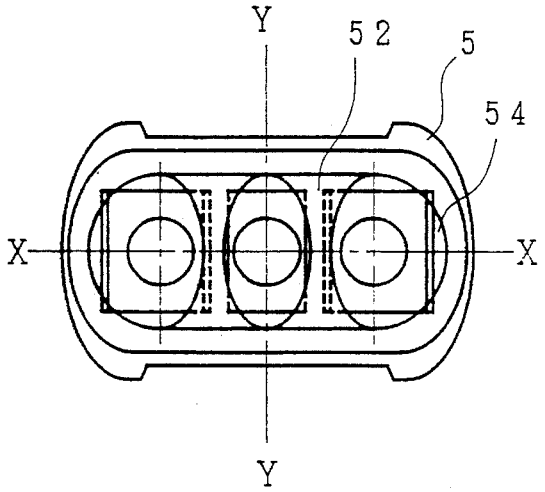
FIGS. 8A thru 8D, FIGS. 9A thru 9D, FIGS. 10A thru 10D, FIGS. 11A thru 11D, FIGS. 12A thru 12D, and FIGS. 13A thru 13D are views used for explaining various practicable examples of the $G_5$-electrode.
Figure 8C:
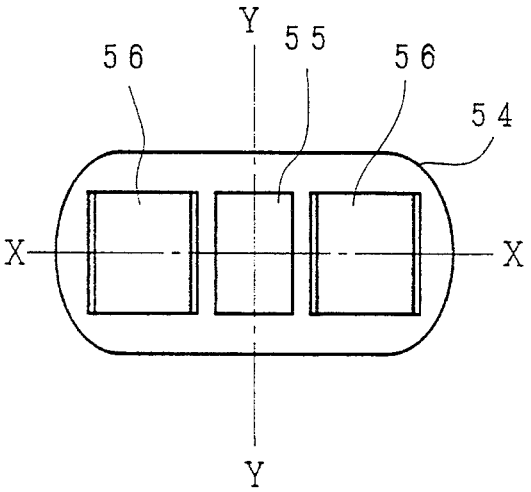
Figure 8B:
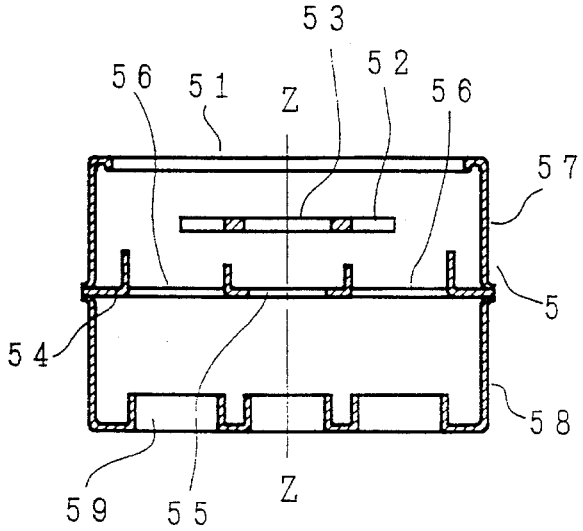
Figure 8D:
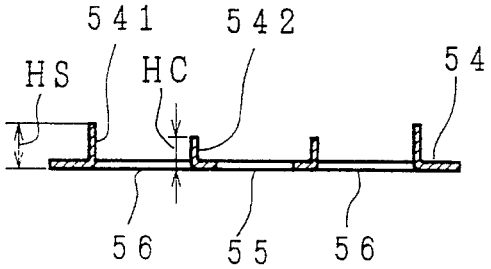
Figure 9A:
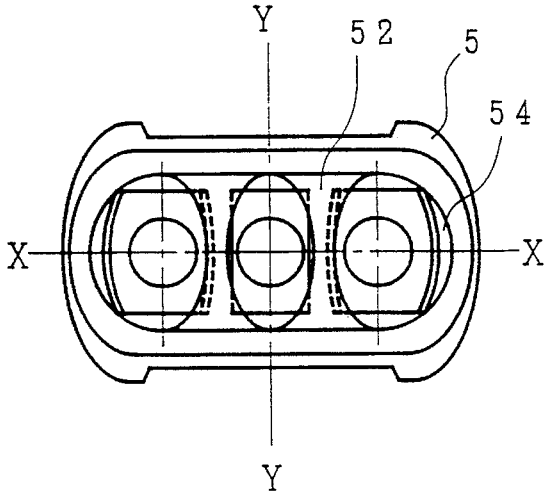
Figure 9C:
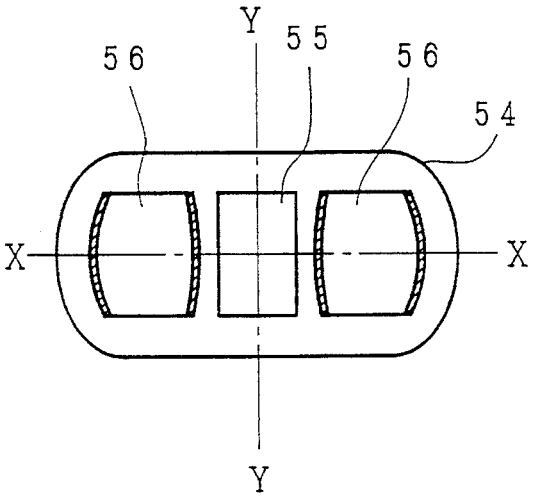
Figure 9B:
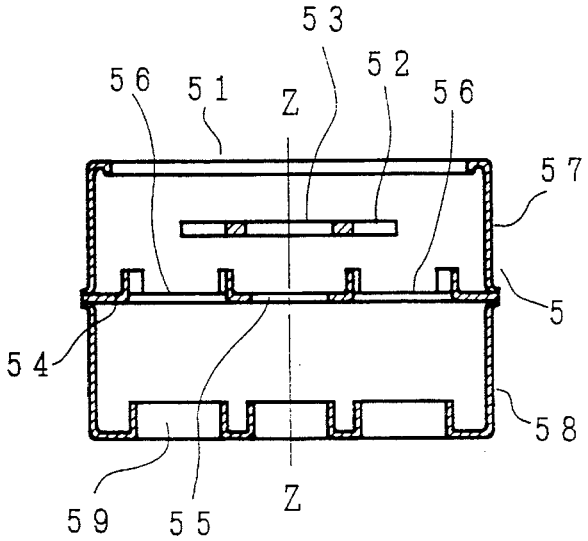
Figure 9D:
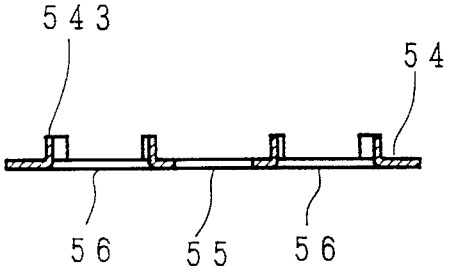
Figure 10A:
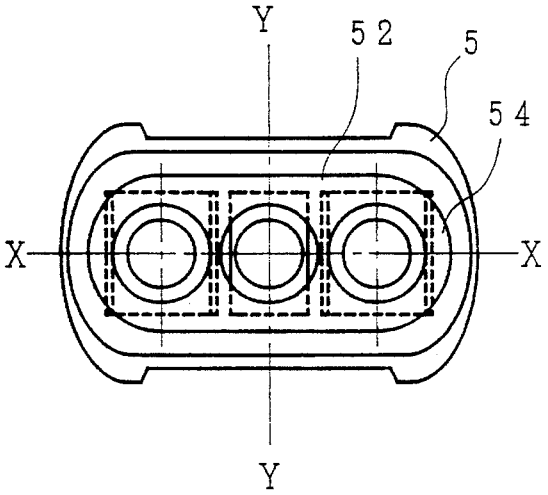
Figure 10C:
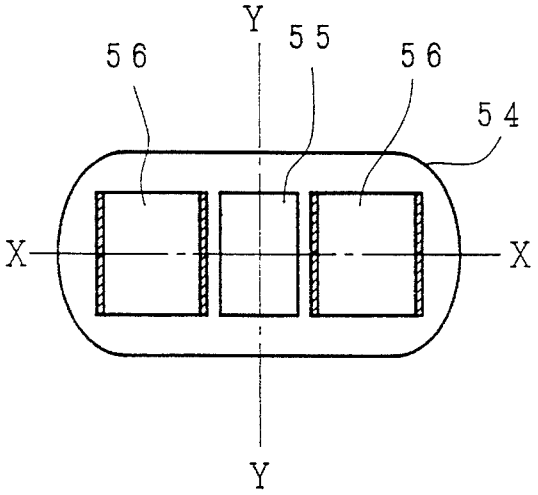
Figure 10B:
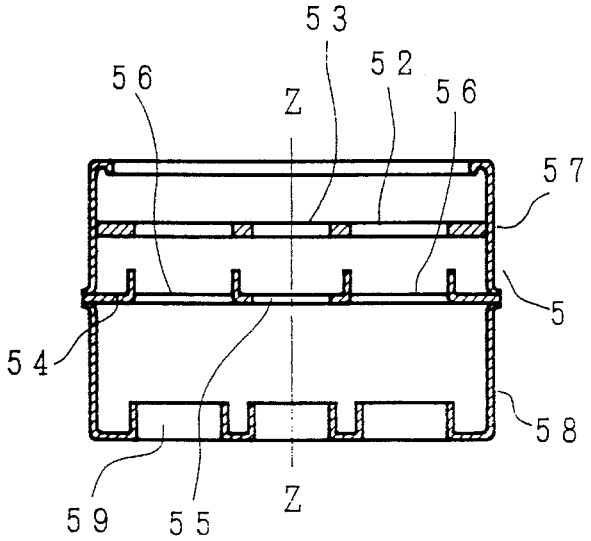
Figure 10D:
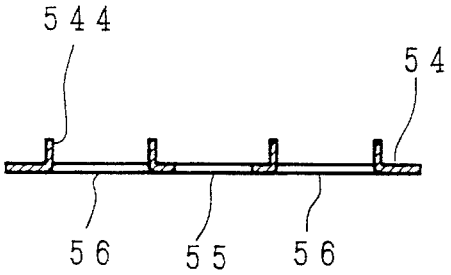
Figure 11A:
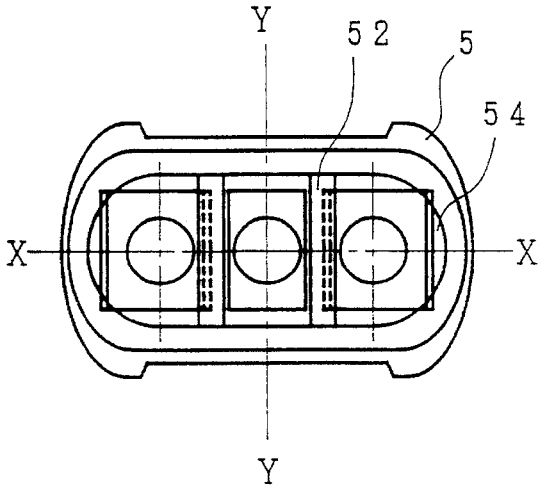
Figure 11C:
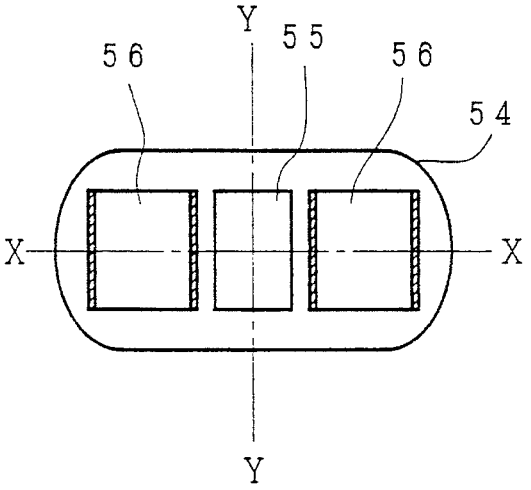
Figure 11B:
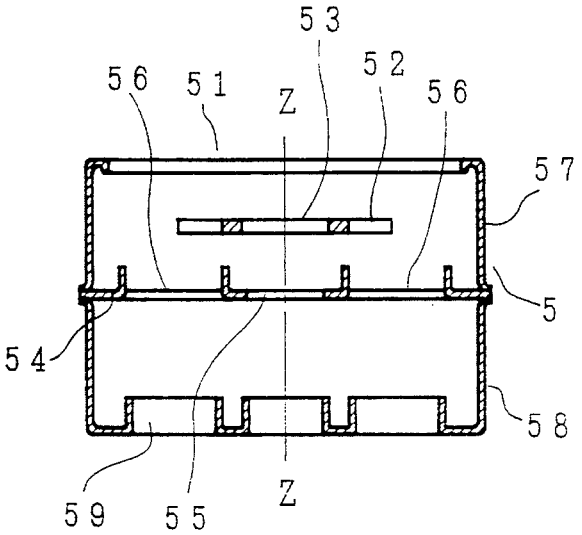
Figure 11D:
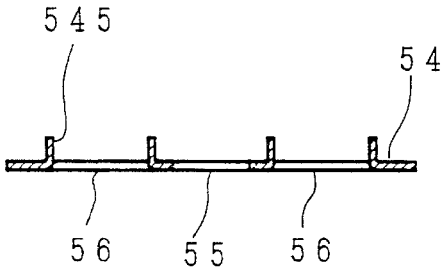
Figure 12A:
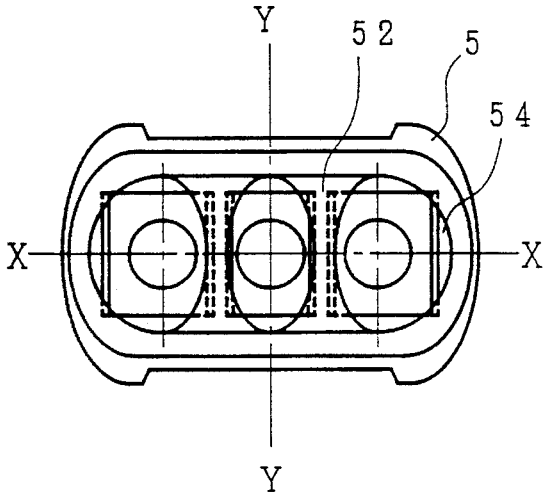
Figure 12C:
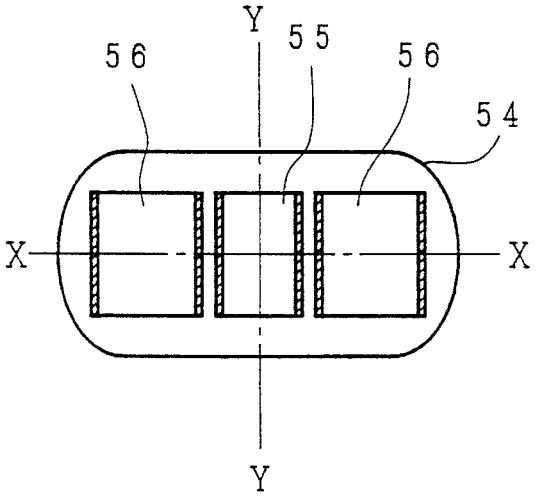
Figure 12B:
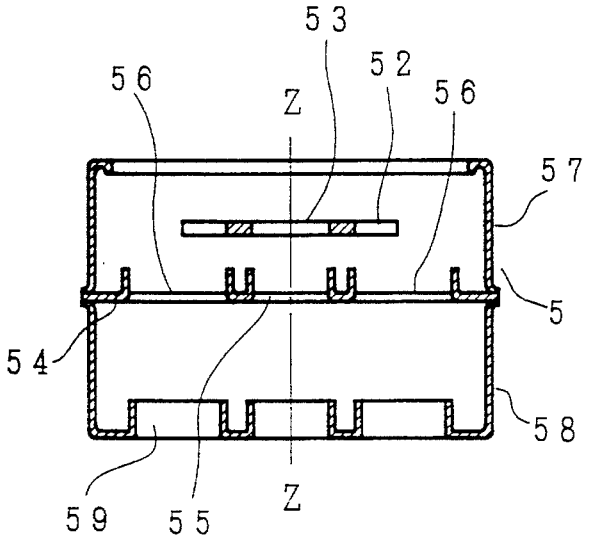
Figure 12D:
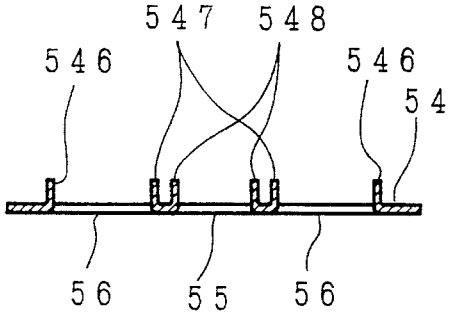
Figure 13A:
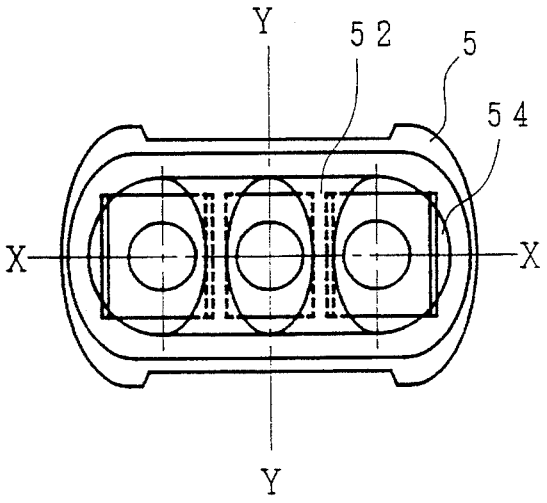
Figure 13C:
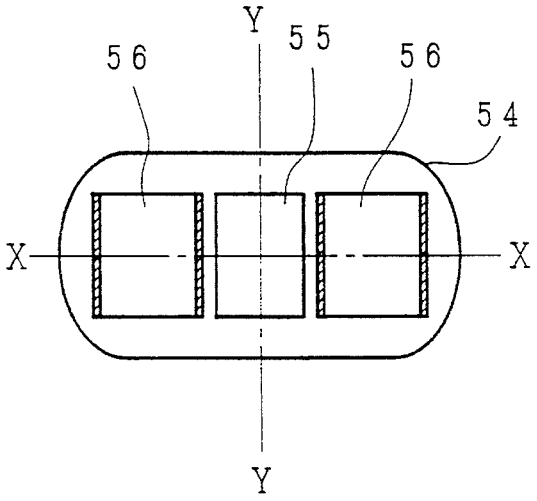
Figure 13B:
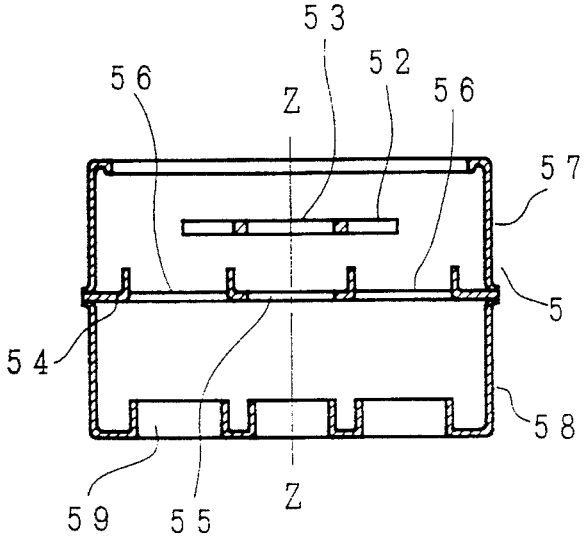
Figure 13D:
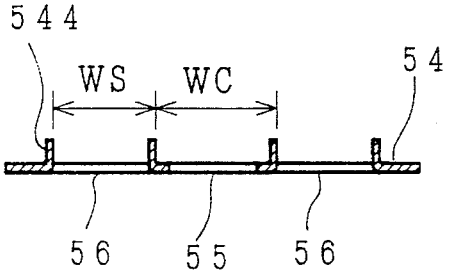
Figure 14A:
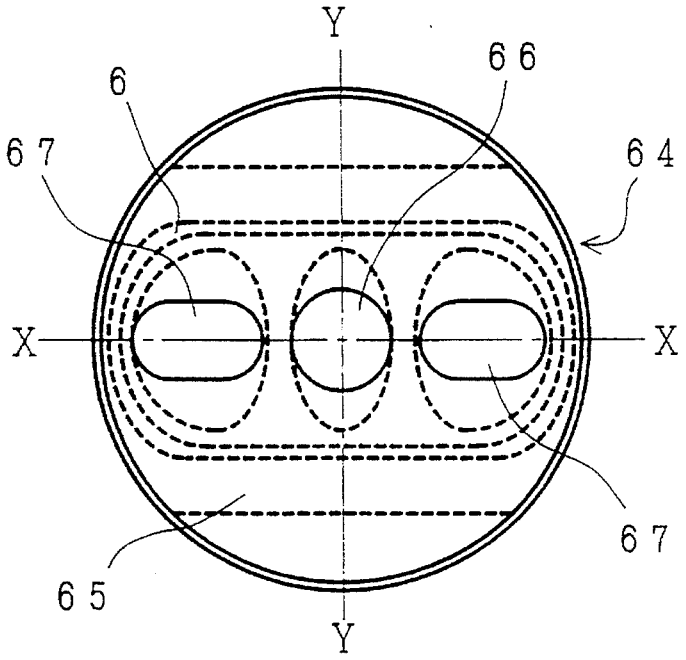
FIGS. 14A thru 14D, FIGS. 15A thru 15D, FIGS. 16A thru 16D, and FIGS. 17A thru 17D are views for explaining various practicable examples of the $G_6$-electrode.
Figure 14B:
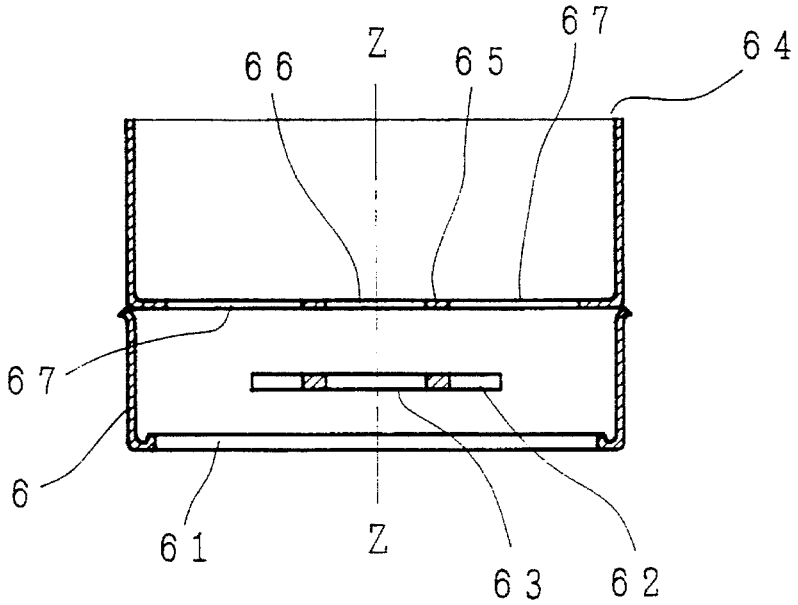
Figure 14C:
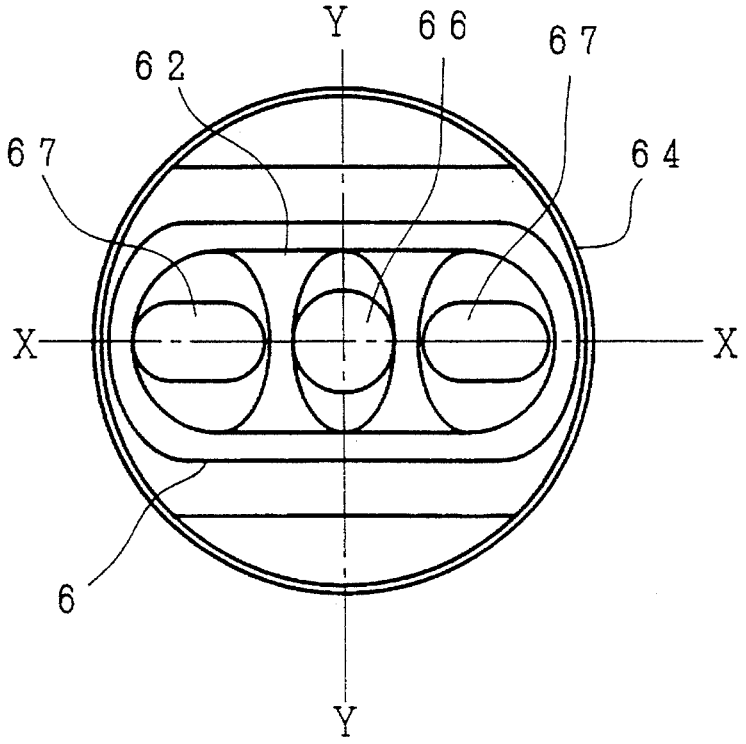
Figure 14D:
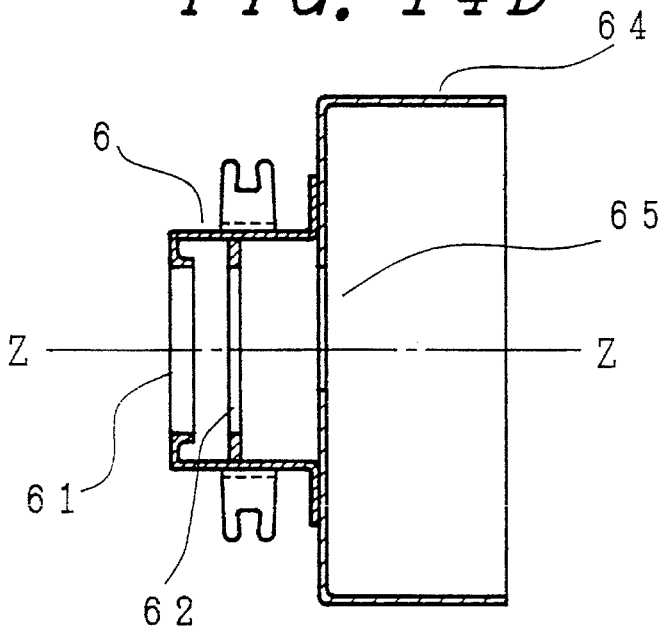
Figure 15A:
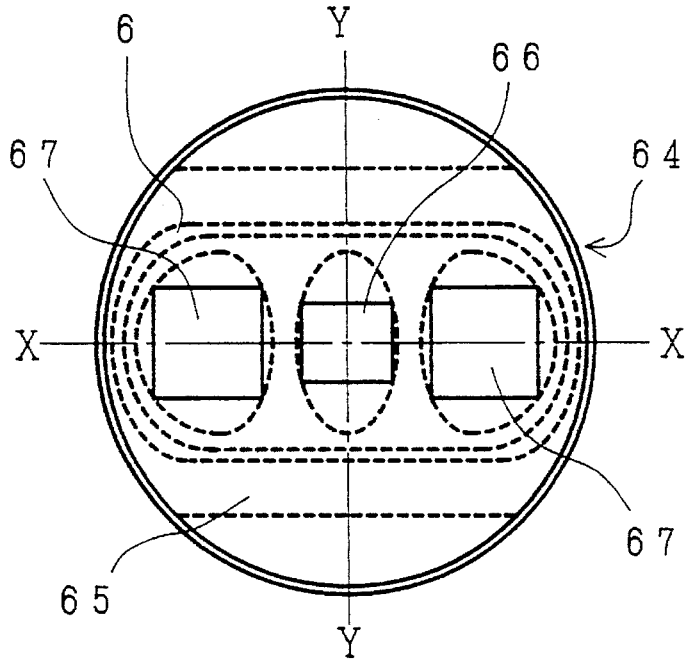
Figure 15B:
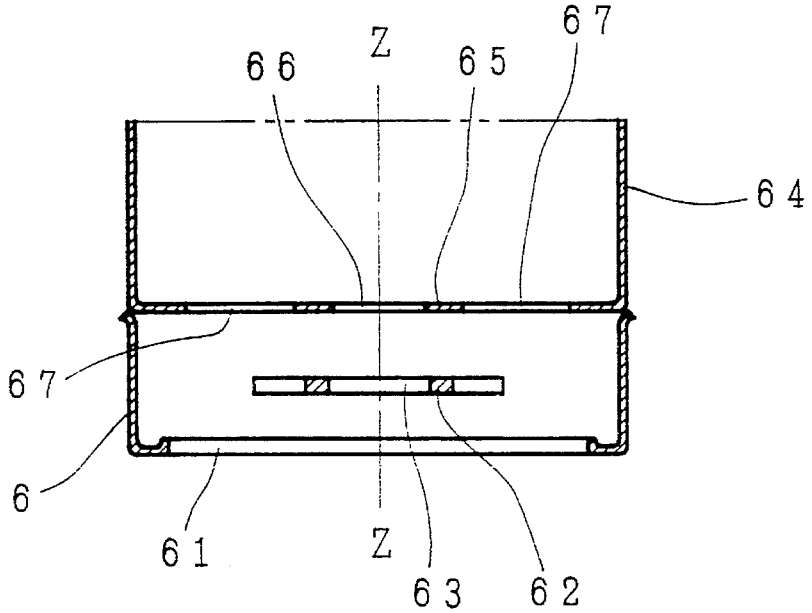
Figure 15C:
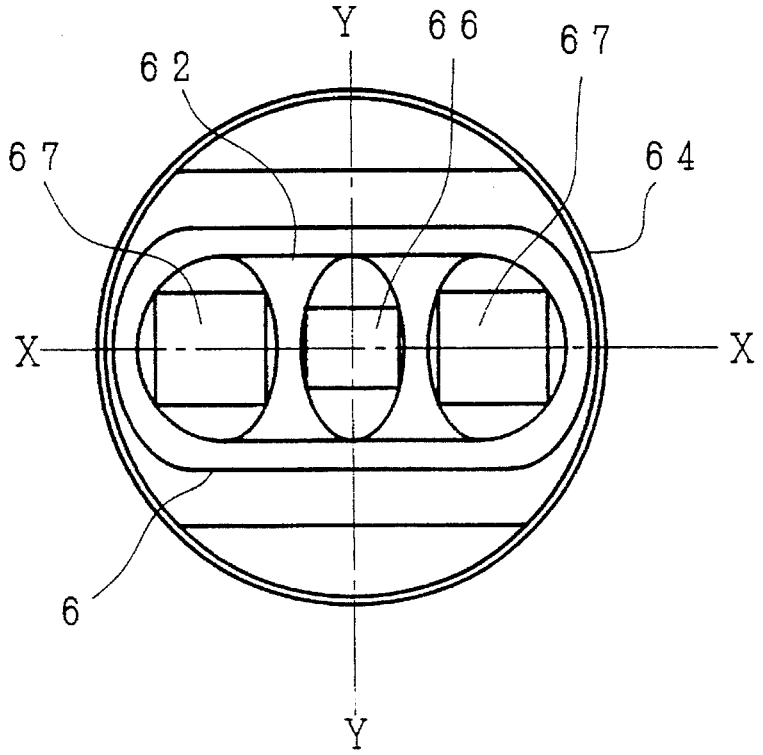
Figure 15D:
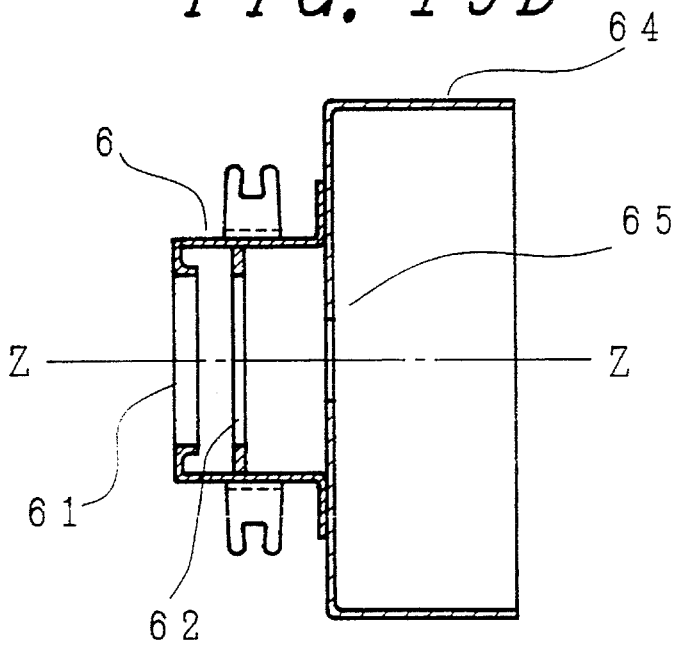
Figure 16A:
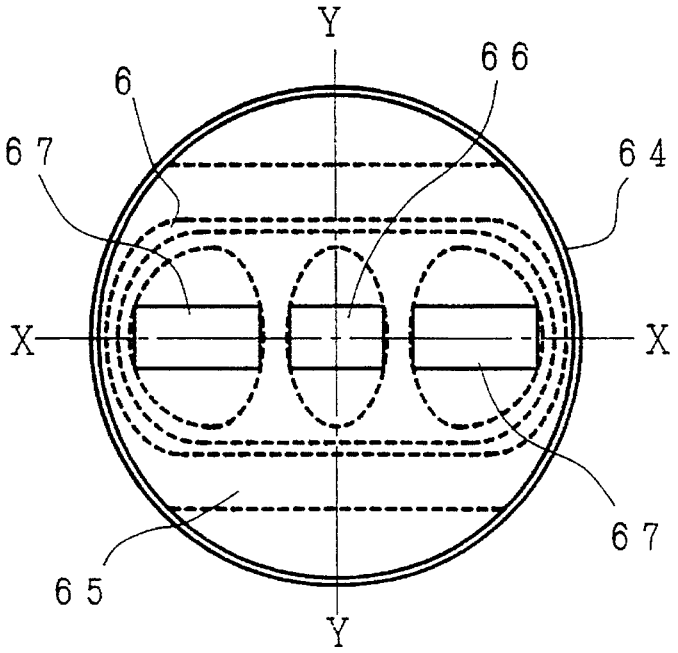
Figure 16B:
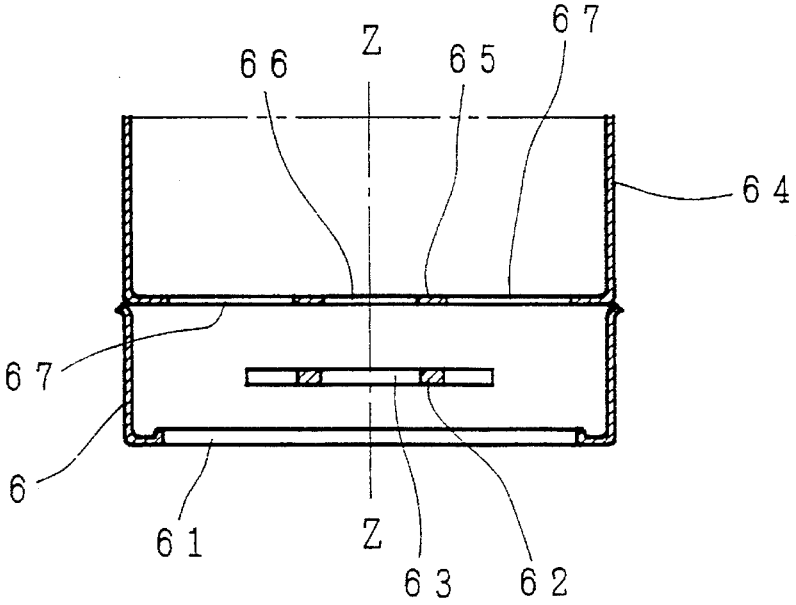
Figure 16C:
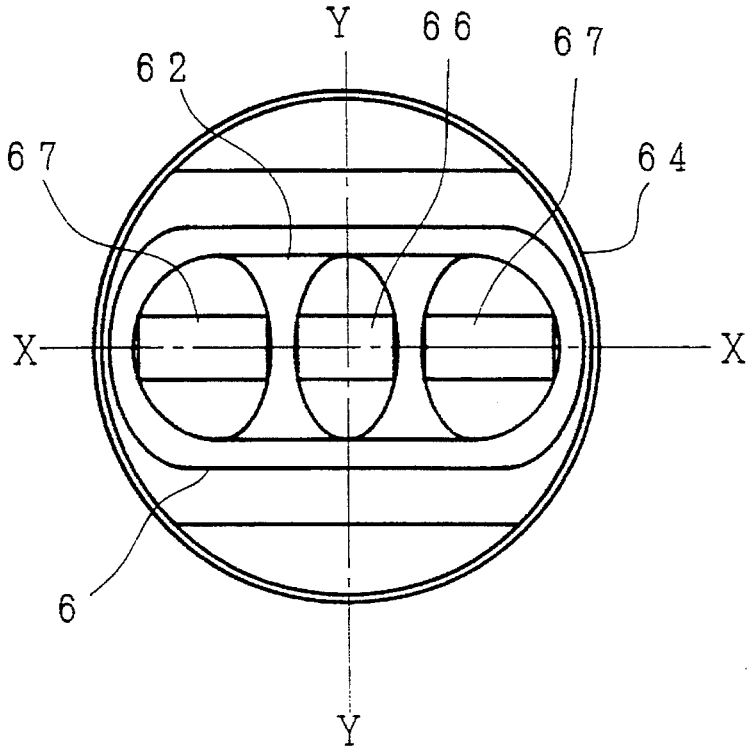
Figure 16D:
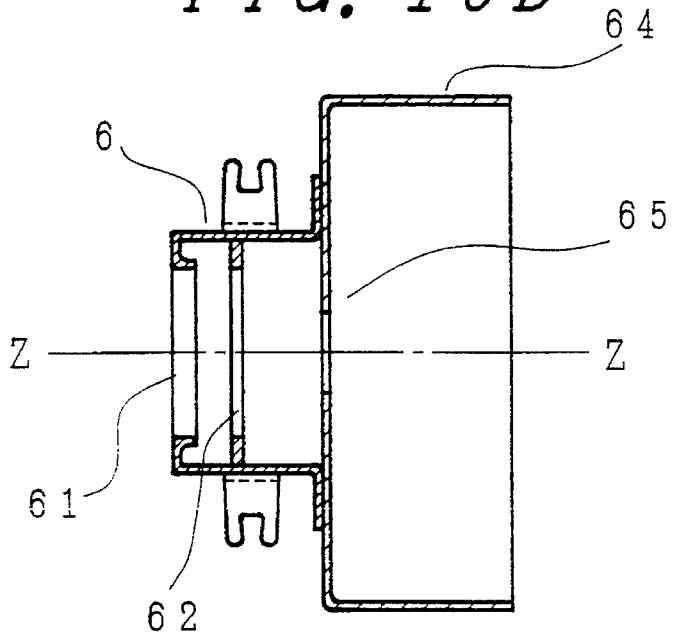
Figure 17A:
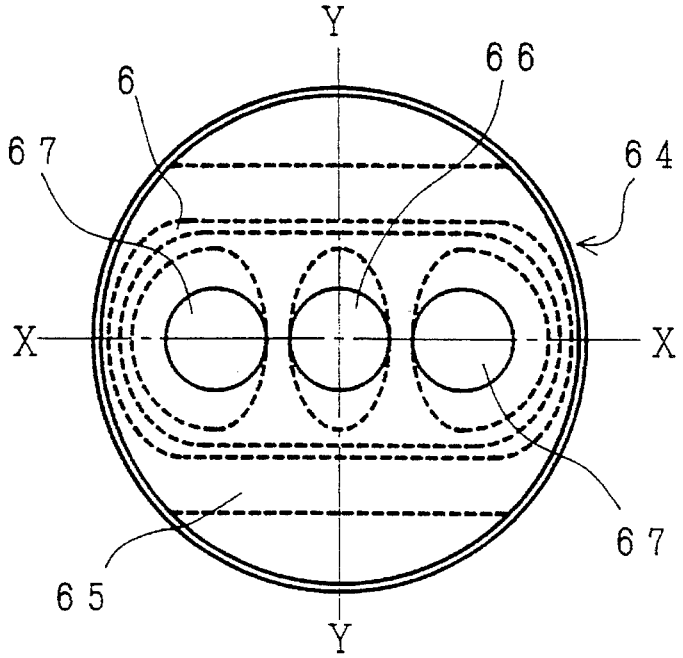
Figure 17B:
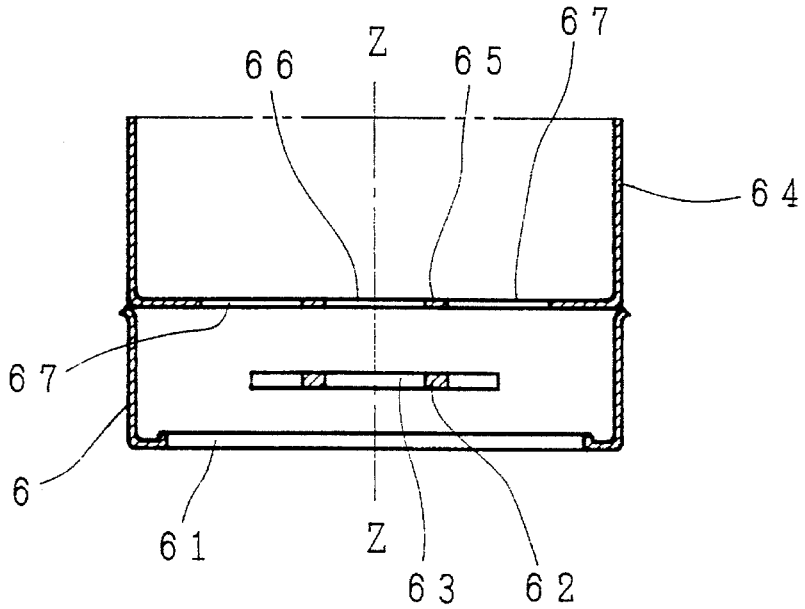
Figure 17C:
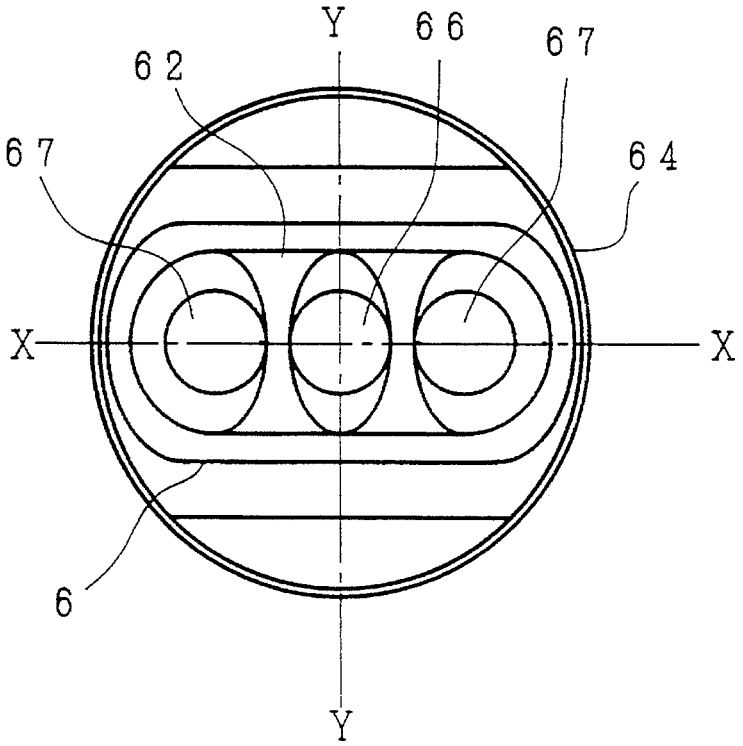
Figure 17D:
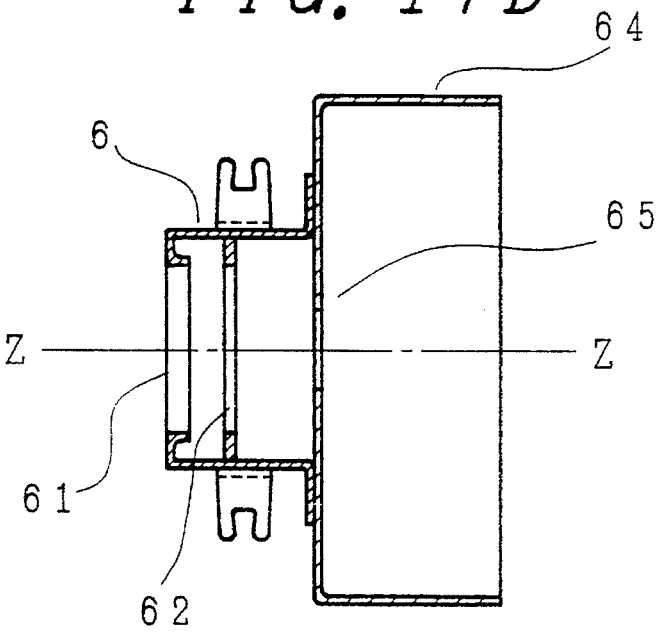

FIGS. 7A thru 7D are structural views used for explaining the main electrodes in FIGS. 1A and 1B. That is, FIG. 7A shows the $G_2$-electrode 2, FIGS. 7B and 7C show the $G_3$-electrode 3, and FIG. 7D shows the $G_4$-electrode 4.

Referring to FIG. 7A, a slit 2*d*, which has a lengthwise axis in the direction parallel to the direction X—X of the array of the in-line electron guns, is provided around each of the electron-beam passing holes 2*c* and on the electron-beam exit side 2b of the $G_2$-electrode 2.

The depth D of the slit 2d, namely, the dimension thereof in the direction of the axis of the cathode-ray tube, and the dimensions $W_5$ and $W_6$ of this slit in directions perpendicular to the tube axis are specified so as to meet the requirements of the overall focusing characteristics of the cathode-ray tube including the characteristics of the other electrodes.

Such specifications meeting the requirements of the overall focusing characteristics are not always unique.

As seen from FIG. 7B, the electron beam entrance 3a of the $G_3$-electrode 3 is provided with slits 3d surrounding electron-beam passing holes 3c.

The slit 3d has a lengthwise axis in the direction perpendicular to the direction of the in-line array around the electron-beam passing hole 3c. In this example, a recess as the slit 3d is formed in the side wall of the cup-shaped electrode of the $G_3$-electrode 3 on the side of the $G_2$-electrode 2.

Here, the slit 3d is not restricted to the illustrated shape, but it may well be in a shape in which the ends of the slit along the lengthwise axis thereof are closed.

In the same manner as in the $G_2$-electrode 2, the depth and widthwise dimensions of the slit 3d are determined so as to meet the requirements of the overall focusing characteristics of the cathode-ray tube including the focusing characteristics of the other electrodes which are not unique.

FIG. 7C is a sectional view taken along line X—X in FIG. 7B.

FIG. 7D illustrates the detailed structure cf the $G_4$-electrode 4. A slit 4d having a longitudinal axis in the direction Y—Y perpendicular to the direction X—X of the in-line array is provided around each of electron-beam passing holes 4c and in the electron-beam exit 4b of the electrode 4.

In this case, like the situation of to the $G_2$- or $G_3$-electrode, the depth and widthwise dimensions of the slit 4d are determined so as to meet the requirements of the overall focusing characteristics of the cathode-ray tube including the focusing characteristics of the other electrodes which are not unique, either.

FIGS. 8A thru 8D, FIGS. 9A thru 9D, FIGS. 10A thru 10D, FIGS. 11A thru 11D, FIGS. 12A thru 12D, and FIGS. 13A thru 13D are structural views for explaining various practicable examples of the $G_5$-electrode (focusing electrode) 5. Each figure labeled A is a front view of the $G_5$-electrode 5 seen from the side of the $G_6$-electrode (anode) 6, each figure labeled B is a sectional view taken along line X—X in the figure labeled A, each figure labeled C is a front view of the electric-field correcting plate 54, and each figure labeled D is a sectional view taken along line X—X in the figure labeled C.

In the example of FIGS. 8A–8D, the electric-field correcting plate 54 is formed with rectangular, electron-beam passing holes and each of the sideward electron-beam passing holes 56 is provided with raised portions 541, 542 which are cut and mounted from the in-line direction into the Z direction of the optic axis so as to sandwich the corresponding electron beam.

The height Hs of the raised portion 541 on the side of the sideward electron-beam passing hole 56 remote from the central electron-beam passing hole 55 is set greater toward the inner electrode 52 than the height Hc of the raised portion 542 on the side near to the central hole 55.

The values of the heights Hs and Hc are determined from the X-directional opening widths of the central electron-beam passing hole 55 and sideward electron-beam passing holes 56, the distance of the correction plate 54 relative to the inner electrode 52, as well as the shapes and dimensions of the openings of this electrode 52, and the overall characteristics of the electron gun assembly.

In the example of FIGS. 9A–9D, the electric-field correcting plate 54 as shown in FIGS. 8A–8D is provided with raised portions in the shapes of curved plates which surround the corresponding one of the sideward electron-beam passing holes 56.

The raised portion in the curved plate shape can also be made higher on the side of the sideward electron-beam passing hole 56 remote from the central hole 55 in the same manner as in FIGS. 8A–8D.

In the example of FIGS. 10A–10D, the electric-field correcting plate 54 is provided with raised portions 544, each pair of which is mounted from the in-line direction so as to sandwich the corresponding one of the sideward electron-beam passing holes 56, and the electron-beam passing holes 53 of the inner electrode 52 for the three electron beams are respectively shaped circular.

In the example of FIGS. 11A–11D, the electron-beam passing holes 53 of the inner electrode 52 as shown in FIGS. 10A–10D are made rectangular (rectangular for the central electron beam, and U-shaped for the sideward electron beams).

The example of FIGS. 12A–12D is such that the raised portions of the electric-field correcting plate 54 for the respective electron beams are constructed of members which are independent of one another. More specifically, the raised portions 548 are provided for the central electron-beam passing hole 55, and the raised portions 546 and 547 are provided for each of the sideward electron-beam passing holes 56.

The example of FIGS. 13A–13D is such that raised portions 544 provided in the electric-field correcting plate 54 have unequal intervals (X-directional widths) for the central electron beam and for each of the sideward electron beams. In the illustration, the interval Wc of the raised portions for the central electron beam is greater than that Ws of the raised portions for the sideward electron beam.

FIGS. 14A thru 14D, FIGS. 15A thru 15D, FIGS. 16A thru 16D, and FIGS. 17A thru 17D are structural views for explaining various practical examples of the $G_6$-electrode (anode) 6 different from the embodiments of the $G_5$-electrode (focusing electrode) 5. Each figure labeled A is a front view of the $G_6$-electrode 6 seen from the side of the screen of the cathode-ray tube, each figure labeled B is a sectional view taken along line X—X in the figure labeled A, each figure labeled C is a front view seen from the side of the $G_5$-electrode 5, and each figure labeled D is a sectional view taken along line Y—Y in the figure labeled C.

In the example of FIGS. 14A–14D, the openings of the electric-field correcting plate 65 are formed of a circular hole for the central electron beam and an elliptic hole having a lengthwise axis in the X direction for each of the sideward electron beams.

The example of FIGS. 15A–15D is such that the openings of the electric-field correcting plate 65 as shown in FIGS. 14A–14D are made rectangular.

The example of FIGS. 16A–16D is such that the openings of the electric-field correcting plate 63 as shown in FIGS. 15A–15D are formed in rectangular shapes each having an X-directional lengthwise axis.

The example of FIGS. 17A–17D is such that the openings of the electric-field correcting plate 65 as shown in FIGS.

15A–15D are respectively made circular for the three electron beams.

The shapes, dimensions and mounting positions of the electric-field correcting plate 65 and inner electrode 62 constituting the $G_6$-electrode 6 as described above can be properly determined according to the required characteristics of the electron gun assembly, in the same manner as in the $G_5$-electrode 5.

FIGS. 18A and 18B and FIGS. 19A and 19B are diagrams for explaining the shapes of electron beam spots on the fluorescent screens of the cathode-ray tubes. Each figure labeled A shows the spots on the fluorescent screen and each figure labeled B shows measurement points on the fluorescent screen.

Figure 18A:
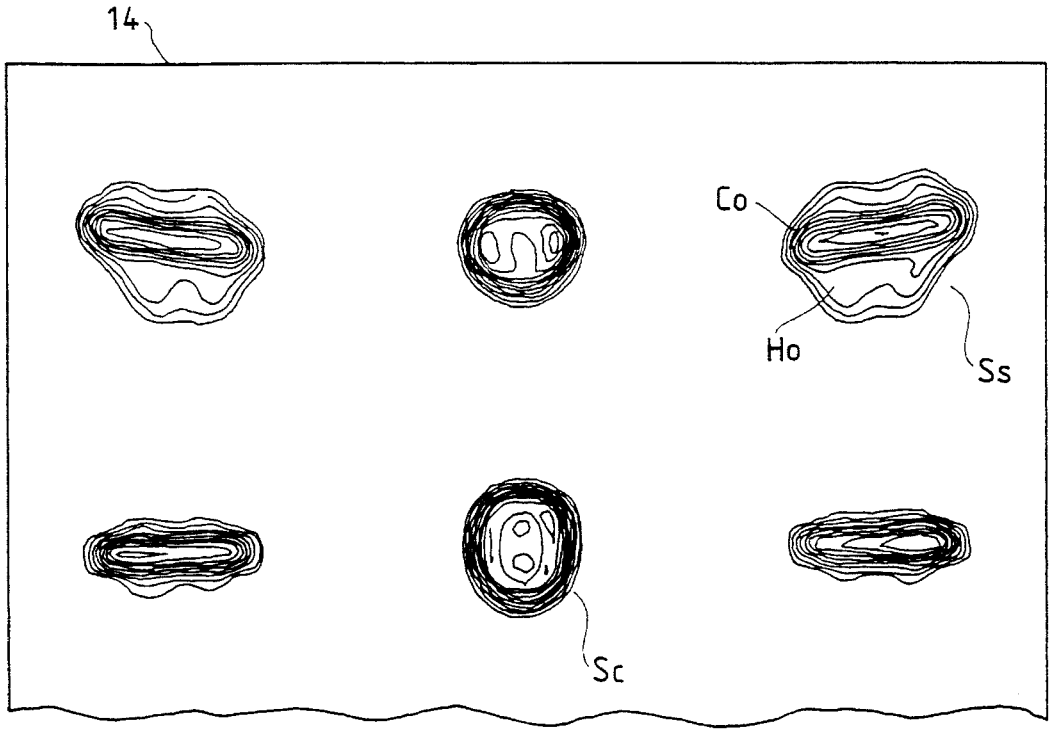
FIGS. 18A and 18B and FIGS. 19A and 19B are diagrams showing the shapes of electron beam spots on the fluorescent screen of a cathode-ray tube while comparing the present invention with the prior art.
Figure 18B:
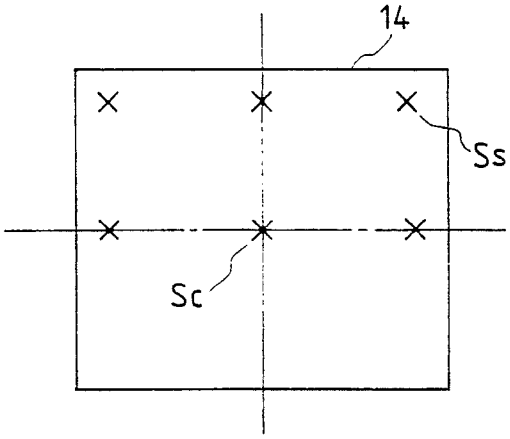
Figure 19A:
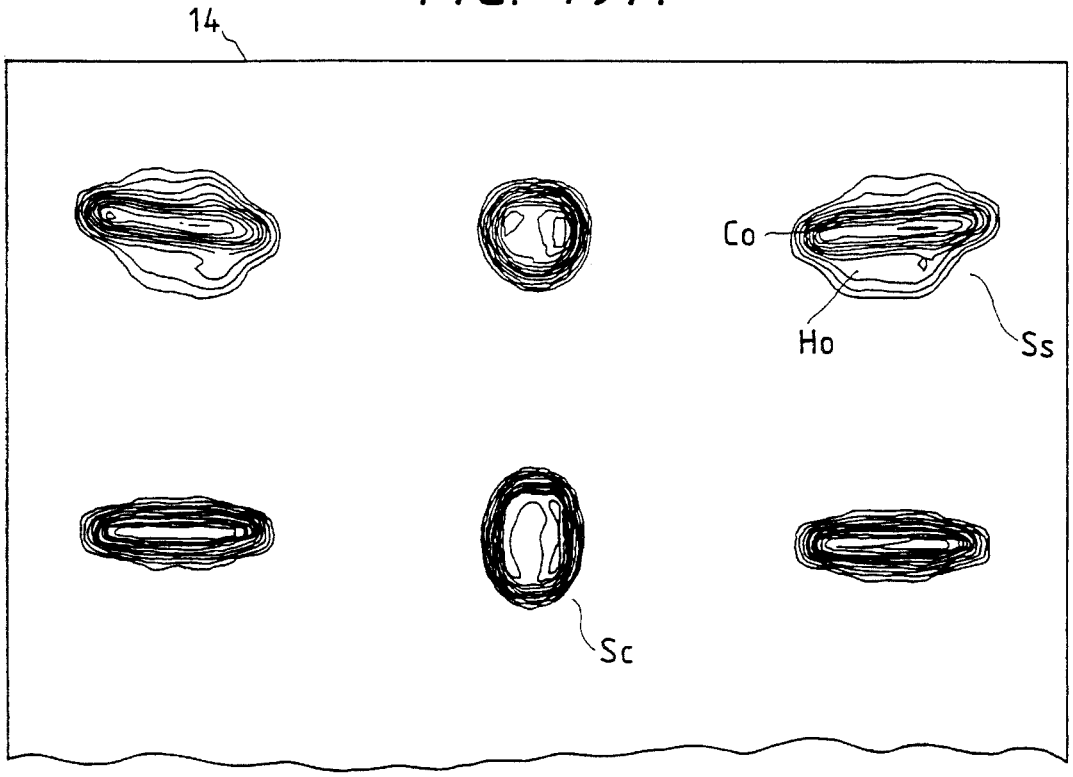
Figure 19B:
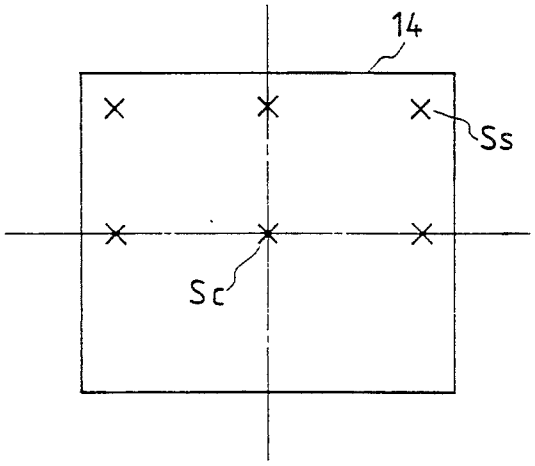

FIGS. 18A and 18B correspond to a case of employing a prior-art electron gun assembly as illustrated for comparison's sake and FIGS. 19A and 19B are a case of employing the electron gun assembly according to the present invention.

As seen by comparing FIG. 18A and FIG. 19A, the electron beam spot Sc at the central part of the fluorescent screen 14 is smaller in diameter in the case of FIG. 19A according to the present invention, than in the prior-art case of FIG. 18A.

Further, when the electron beam spot Sc at the corner part of the fluorescent screen 14 in the case of FIG. 19A according to the present invention is compared with that in the prior-art case of FIG. 18A, the core part Co of this beam spot is smaller and the halo part Ho which greatly affects the picture quality is much smaller.

A precise measurement has revealed that the diameters of the electron beam spots on the fluorescent screen according to the present invention are decreased about 10% with respect to those in the prior art.

As described above, the interiors of the focusing electrode and the anode which constitute the main lens are brought into the electric-field correcting structure so that balanced focusing characteristics can be attained for the whole surface of the fluorescent screen of the cathode-ray tube.

Although the various practicable examples of the present invention have been described above, the present invention is not restricted to the so-called EA-UB type electron gun referred to before. According to the present invention, the electric-field correcting structures are respectively constructed in the interior of the pair of electrodes constituting the main lens of any of electron guns of various types including (a) the BPF type, (b) the UPF type, (c) the HI-FO type (high focusing voltage BPF), (d) the HI-UPF type (high focusing voltage UPF), (e) the B-U type (BPF-UPF hybrid type), and (f) the TPF type, and in other various forms including a multistage focusing type electron gun. With the invention, the focusing characteristics for the whole surface of the fluorescent screen of a cathode-ray tube can be enhanced in balanced fashion and the cathode-ray tube of high resolution is obtained.

As set forth above, according to the present invention, astigmatism corrections are made by the respective electrodes of an electrode pair forming a main lens so that an electron beam is not subjected to an abrupt change in an electric field for the astigmatism corrections.

Accordingly, the trajectory of the electron beam becomes less prone to distortion and a cathode-ray tube of high resolution having a smaller electron-beam spot on a fluorescent screen is obtained.

More specifically, the present invention can reduce the average diameter of the electron-beam spot on the fluorescent screen by about 10% as compared with the prior art where an electric-field correcting structure made of an electric-field correcting plate is provided in only one of the electrodes forming the main lens.

Moreover, according to the present invention, the astigmatism corrections are made by adopting the electric-field correcting structures made of electric-field correcting plates, which are disposed within the respective electrodes of the electrode pair at positions spaced in the direction of an optic axis from the opposed parts of the electrode pair forming the main lens. Thus, the accuracy of each of the electric-field correcting structures can he reduced to about one-third with respect to the accuracy in the prior art.

Further, according to the present invention, the structures for the astigmatism corrections are mounted in the respective electrodes of the electrode pair constructing the main lens at the positions spaced in the direction of the optic axis from the opposed parts of the electrode pair. Due to the shielding actions of the opposed parts of the electrode pair, the structures of the electric-field correcting plates may be less precise relative to the action of focusing three electron beams on the fluorescent screen.

What is claimed is:

1. An electron gun for producing at least one electron beam which scans a target which fluoresces comprising:

axially opposed inner electrode plates of a focusing electrode and an anode electrode constituting a main lens for the at least one electron beam producing a rotationally-asymmetric electric field distribution; and an electric-field correcting portion provided in at least said focusing electrode at a position in an axial direction spaced from and outside of a region defined between the axially opposed inner electrode plates of said focusing electrode and said anode electrode constituting the main lens for producing an additional lens action for the at least one electron beam which changes the rotationally asymmetric electric field produced by the main lens into a substantially rotationally symmetric electric field.

2. An electron gun according to claim 1 further comprising:

noncircular electron beam passing holes formed in the axially opposed inner electrode plates of the focusing electrode and the anode electrode constituting the main lens.

3. An electron gun according to claim 1, further comprising:

noncircular electron beam passing holes formed in said electric-field correcting portion provided in at least said focusing electrode.

4. An electron gun for producing at least one electron beam which scans a target which fluoresces comprising:

axially opposed inner electrode plates of a focusing electrode and an anode electrode constituting a main lens for the at least one electron beam producing a rotationally-asymmetric electric field distribution;

an electric-field correcting portion which is provided in said anode electrode at a position in an axial direction spaced from and outside of a region defined between the axially opposed inner electrode plates for producing an additional diverging or focusing lens action which changes the rotationally asymmetric electric field produced by the main lens into a substantially rotationally symmetric electric field exerted on the at least one electron beam in a space extending from a substantially middle position of the main lens to the anode electrode; and another electric-field correcting portion which is provided in said focusing electrode at a position in the axial direction spaced from and outside of the region defined between the axially opposed inner electrode plates and which has different focusing lens actions in two orthogonal directions perpendicular to the axial direction.

5. An electron gun according to claim 4, further comprising:

noncircular electron beam passing holes formed in the axially opposed inner electrode plates of the focusing electrode and the anode electrode constituting the main lens.

6. An electron gun according to claim 4, further comprising noncircular electron beam passing holes formed in the electric field correcting portion provided in said anode electrode and formed in the another electric-field correction portion provided in said focusing electrode.

7. A color cathode-ray tube having three electron guns arrayed in-line with each electron gun having a plurality of electrodes, a deflection device, and a fluorescent screen, wherein said electron guns each produce an electron beam which scans a target which fluoresces, comprising:

axially opposed inner electrode plates of a focusing electrode and an anode electrode constituting a main lens for the electron beams producing a rotationally-asymmetric electric field distribution;

at least one lens other than said main lens which produces a rotationally-asymmetric electric field, an aggregated effect of said main lens and said at least one other lens having a rotationally-asymmetric electric field as a total effect of the electron guns exerted on the electron beams;

an electric-field correcting portion provided in at least said focusing electrode at a position in an axial direction spaced from and outside of a region defined between the axially opposed inner electrode plates of said focusing electrode and said anode electrode constituting the main lens for producing an additional lens action in order to make a more rotationally-symmetric electric field effect aggregated with said main lens and said at least one other lens as a total effect of the electron guns exerted on the electron beams than the electric field of said main lens and said at least one other lens.

8. A color cathode-ray tube according to claim 7, further comprising noncircular electron beam passing holes formed in said axially opposed inner electrode plates in said focusing electrode and said anode electrode constituting said main lens.

9. A color cathode-ray tube according to claim 7, further comprising noncircular electron beam passing holes formed in said electric field correcting portion provided in at least said focusing electrode.

10. A color cathode-ray tube having three electron guns arrayed in-line with each electron gun having a plurality of electrodes, a deflection device, and a fluorescent screen, wherein said electron guns each produce an electron beam which scans a target which fluoresces, comprising:

axially opposed inner electrode portions of a focusing electrode and an anode electrode constituting a main lens for said electron beams and producing a rotationally-asymmetric electric field distribution; and an additional electric-field correcting portion provided in at least said focusing electrode at a position spaced in an axial direction from said axially opposed inner electrode portions of said focusing electrode and said anode electrode constituting said main lens with respect to a part which separates three electron beam passing holes and which is formed in the vicinity of said axially opposed inner electrode portions, said additional electric-field correcting portion having different focusing lens actions in two orthogonal directions perpendicular to the axial direction.

11. A color cathode-ray tube according to claim 10, further comprising noncircular electron beam passing holes formed in said axially opposed inner electrode portions in said focusing electrode and said anode electrode constituting said main lens.

12. A color cathode-ray tube according to claim 10, further comprising noncircular electron beam passing holes formed in said additional electric-field correcting portion provided in at least said focusing electrode.

* * * * *